US006246306B1

(12) United States Patent
Gruner

(10) Patent No.: US 6,246,306 B1
(45) Date of Patent: Jun. 12, 2001

(54) ELECTROMAGNETIC RELAY WITH PRESSURE SPRING

(76) Inventor: Klaus A. Gruner, 1275 Broadway, Village of Lakewood, IL (US) 60014

( * ) Notice: Subject to any disclaimer, the term of this patent is extended or adjusted under 35 U.S.C. 154(b) by 0 days.

(21) Appl. No.: 09/643,436

(22) Filed: Aug. 22, 2000

Related U.S. Application Data

(63) Continuation-in-part of application No. 09/427,328, filed on Oct. 26, 1999, which is a continuation-in-part of application No. 09/244,925, filed on Feb. 4, 1999.

(51) Int. Cl.[7] ..... H01H 51/22
(52) U.S. Cl. ..... 335/83; 335/129; 335/133
(58) Field of Search ..... 335/78–86, 124, 335/128, 133, 130, 129, 131

(56) References Cited

U.S. PATENT DOCUMENTS 4,403,203 * 9/1983 Schedele ..... 335/78
5,243,312 * 9/1993 Schedele ..... 335/78

* cited by examiner

*Primary Examiner*—Lincoln Donovan
*Assistant Examiner*—Tuyen T. Nguyen
(74) *Attorney, Agent, or Firm*—Charles F. Meroni, Jr.; Meroni & Meroni, P.C.

(57) ABSTRACT

The electromagnetic relay has a motor assembly with a bobbin secured to a housing. A core is adjacently connected below the bobbin except for a core end, which extends from the bobbin. An armature end magnetically engages the core end when the coil is energized. An actuator engages the armature and a plurality of center contact spring assemblies. The center contact spring assembly is comprised of a center contact spring which is not pre bent and is ultrasonically welded onto a center contact terminal. A normally open spring is positioned relatively parallel to a center contact spring. The normally open spring is ultrasonically welded onto a normally open terminal to form a normally open outer contact spring assembly. A normally closed outer contact spring is vertically positioned with respect to the center contact spring so that the normally closed outer contact spring assembly is in contact with the center contact spring assembly, when the center contact spring is not being acted upon by the actuator. The normally closed spring is ultrasonically welded onto a normally closed terminal to form a normally closed assembly. A pressure spring pressures the center contact spring above the actuator when the actuator is not in use.

32 Claims, 30 Drawing Sheets

ELECTROMAGNETIC RELAY WITH PRESSURE SPRING

Prior History

This application is a Continuation-In-Part application of U.S. patent application Ser. No. 09/427,328 filed on Oct. 26, 1999, which is a Continuation-In-Part of a U.S. patent application Ser. No. 09/244,925 filed on Feb. 04, 1999.

BACKGROUND OF THE INVENTION

1. Field of the Invention

The present invention relates generally to electromagnetic relays, more particularly, to a miniature power switching relay specifically designed for mounting on printed circuit boards. The present invention utilizes a pressure spring inserted into the relay housing for pressuring a center contact spring into position and providing for normally contact pressure without pre bending the center contact spring. The present invention further utilizes ultrasonic welding of the copper terminals and the center contact springs as well as the copper terminals and the normally open and normally closed contact springs creating higher conductivity properties and greater contact area.

2. Description of the Prior Art

Electromagnetic switching devices, commonly referred to as relays, have been used for many years and there is a continuing need for such a device which is small in size. Yet, moreover, there is a need for such a device capable of reliably handling relatively high current switching jobs. This requirement for miniaturization together with higher contact rating reliability has become particularly important in recent years because of the increasingly common practice of mounting relays on printed circuit boards.

In the design of an electromagnetic relay and other such electromagnetic devices an important consideration is the design of the "magnetic circuit." The design of an effective magnetic circuit determines to a great extent the current switching capability of the relay and the power needed to operate it. The magnetic circuit of a relay generally includes the core inside the relay coil, the relay frame and the armature that moves an actuator, and then the actuator moves the relay contacts. In addition, air gaps exist between the armature and the core of the relay coil at an exposed end.

In relay operation electrical current is sent throughout the relay coil. The current running throughout the relay coil sets up a magnetic field in this magnetic circuit and it is the strength of the magnetic field generated in the air gap between the armature and the core inside the relay coil at an exposed end that is the force that causes the armature to move into contact with the core inside the relay coil at an exposed end providing the motion to operate the switching of the relay contacts. In the relay, the core inside the relay coil, the frame and armature are made of materials that can be easily magnetized and has low residual magnetism. The air gaps, however, resist the establishment of a magnetic field, and the air gap between the armature and the core inside the relay coil has by far the most significant resistance to a magnetic field in the magnetic circuit. In obtaining switching capability for the relay, it is desirable to design effective contact travel distances and rapid movement of the contacts by the armature. It is also desirable to provide the strongest possible magnetic field at this armature gap for the available coil current. This provides for positive and rapid contact movement. A strong return (pressure) spring allows for return movement of the armature when the relay current is removed causing positive and rapid contact movement.

Therefore, the mechanical arrangement of the magnetic core, relay armature, resulting air gap and the design of their interfaces significantly affect the ability of the relay to perform its function as an electrical switching device. It is desirable to maintain a minimum air gap between the core and the armature. This air gap must be tailored to the design of the relays function achieving the intended movement needed to move the center contact spring(s) with the center contact rivets to the required distance for proper contact switching.

Conventional relays presently on the market use a center contact spring with single headed contact buttons for normally closed and normally open contact arrangement or with double headed contact buttons for change over contact arrangement. The center contact spring is pre bent to achieve the necessary contact pressure and to hold the actuator in place of the relay where the pre bent center contact spring holds down above the actuator to contact the rivet of the normally closed contact spring. The overtravel is the distance between where a rivet of the center contact spring starts to contact a rivet of either the normally closed spring or normally open spring and where the contacting rivets reach stable position. This overtravel causes contact wiping between the contact areas of a rivet of the center contact spring and corresponding contact areas of rivets of either the normally closed spring or normally open spring.

Overtravel and contact wiping are essential in a relay for better reliability and longer life of the relay. The overtravel is necessary to make sure that burned off or evaporated material, which occurs at every switching operation, is eliminated. The overtravel further causes contact wiping which cleans the contact surfaces. At every switching operation, a micro weld is formed which needs to be broken when the contact is supposed to open. To break these micro welds, a shearing force is provided by the contact wiping. To achieve the overtravel, a minimum contact force is required. This required contact force is generated by the deflection of the pre bending of the center contact spring in conventional relays.

Pre bending of the center contact spring, though, contains limitations. The pre bending results in limits of the flexibility and deflection of the center contact spring. In order to achieve the required contact pressure for the overtravel and to hold the actuator down in the un-energized state, a minimum deflection is required. Based on the material characteristics of the center contact spring, a maximum deflection of the center contact spring is allowed before the center contact spring loses its spring property partially, which means that the center contact spring will no longer be able to return to its original position. Thus, the center contact spring may be stressed beyond its limits resulting in loss of contact pressure and causing the failure of the relay. In order to remedy this situation, conventional relays reduce the thickness of the center contact spring which results in reduced contact pressure, reduced overtravel, reduced center contact spring cross section and reduced contact rating.

The present invention fulfills the need for a device, which is small in size, yet capable of reliably handling high current switching jobs relative to known designs. The present invention solves the high current problem in a small size by using a combination contact assembly with a pressure spring.

Further, in conventional relays, it is known that bi-metal contact assemblies are used in electromagnetic relays. These known electromagnetic relays use bronze and brass materials for the springs and terminals. In addition, the springs and terminals are spot welded together.

A problem with the known brass and bronze materials is that these materials have low current conductivity properties. In addition, spot welding produces a limited contact area for the electrical current to flow through between the springs and the terminals resulting in lower current handling potential. During assembly, it is difficult to join the springs as single entities with almost no electrical resistance between the connections. Low electrical resistance is required if high electrical current is carried over these contact spring assemblies. The difficulty in assemblies lies in the high electrical conductivity of the individual springs and terminals, which do not allow for spot welding. Even if spot welding were possible, the springs are only connected during spot welding by small areas, which would then become bottle necks for the current flow.

U.S. Pat. No. 5,160,910 issued to Tsuji discloses an electromagnetic relay comprising a relay motor, an armature interacting with the relay motor, an actuator, first and second terminals, contact springs, and a center contact spring assembly. In this relay, the relay motor moves the armature by electromagnetic force, which in turn moves the actuator. The actuator moves the center contact spring to contact either the first or second terminal to complete the current flow.

This relay contains limitations, though. First, the contact springs are not made from a high conductive copper alloy and the terminals are not made from pure copper. Further, the contact springs and terminals are spot welded together as opposed to ultrasonically metal-to-metal welded to each other. Thus, the relay is comprised of less conductive material with less contact surface between the springs and terminals as they are not ultrasonically metal-to-metal welded together.

Further, the relay utilizes a pre bent center contact spring as opposed to a pressure spring to hold the center contact spring in place while the actuator is not acting on the pre bent center contact spring. Thus, the relay has less overtravel resulting in a shorter relay life. The pre bent contact spring does not allow for 1.5 mm resp. 3.0 mm contact gap, which is required by VDE, TUV and other certifying agencies when the relay is used for certain applications.

U.S. Pat. No. 5,250,914 issued to Schedele discloses an electromagnetic relay comprising a contact system, an armature and actuator. In this relay, the contact system which contains at least one movable contact element is mounted inside the housing by a clamp or glue joint or by ultrasonic welding. Further, the armature and actuator can be connected by an ultrasonic weld.

This relay also contains limitations. First, the contact springs are not made from a high conductive copper alloy and the terminals are not made from pure copper. Further, the relay utilizes a pre bent contact spring as opposed to a pressure spring to hold the center contact spring in place, and provide the necessary normally closed contact pressure. The pre bent contact spring in prior art does not allow for 1.5 mm resp. 3.0 mm contact gap, which is required by VDE, TUV and other certifying agencies when the relay is used for certain applications. Also, the relay has less overtravel resulting in a shorter relay life. Further, the ultrasonic welding disclosed in the prior art does not ultrasonically weld the contact and springs to provide greater contact surface for conductivity. Still further, the ultrasonic welding disclosed in the prior art does not even provide a metal-to-metal ultrasonic welding. The ultrasonic welding disclosed only refers to attaching the spring assemblies to the housing and to attaching the actuator to the armature, which has to be made from plastic or non-electrically conductive material.

Accordingly, there is a need for an electromagnetic relay that is small in size yet capable of handling high current switching and also with 1.5 mm resp. 3.0 mm contact gap.

Accordingly, there is also a need for an electromagnetic relay with a contact assembly comprised of more conductive material than brass and bronze and having a greater contact surface between the springs and the terminals.

Accordingly, there is also a need for an electromagnetic relay without a pre bent center contact spring.

Accordingly, there is also a need for an electromagnetic relay with large contact gap.

Accordingly, there is also a need for an electromagnetic relay with higher switching and operating current.

The present invention solves all of these problems. First, the springs and terminals are made of high current conductive materials namely copper alloys with maximum spring properties and pure copper. Secondly, the parts are ultrasonically metal-to-metal welded together which produces a large contact area between the springs and the terminals resulting in higher current handling potential. Thirdly, a pressure spring is inserted into the housing for producing the required normally closed contact pressure without pre bending the center contact spring. Therefore, by using materials with high conductivity properties and increasing the contact area between the terminal and the spring and using a pressure spring, the present invention can handle higher currents while maintaining a relatively small overall package size. The present invention can handle at least 25 amps in a single pole embodiment and at least 12.5 amps in a double pole embodiment.

The pressure springs allow for less deflection of the center contact springs, therefore, thicker contact springs resulting in higher switching and operating current. The pressure springs also make it possible to significantly increase the contact gap. For example, contact gap of 1.5 mm resp. 3.0 mm can be provided in the relays by using present invention. These contact gaps are required by VDE, TUV and other certifying agencies when the relay is used for certain applications. The large contact gap is also desirable for high voltage DC switching. In order to increase the switching and operating current while minimizing the heat generated by higher currents only two options are currently available. One is to make the center contact spring wider, which requires an increase in the overall size of the relay. The other is to increase the thickness of the center contact spring, which results in higher bending force requiring a stronger relay motor which also requires an increase in the size of the relay.

Some other conventional relays employ a latching magnetic motor. There are a few designs for latching magnetic relays currently in the prior art. These latching magnetic relays typically include a relay motor assembly that is magnetically coupled to the actuator. The relay motor typically drives the actuator, which in turn drives the center contact rivet of the center contact spring into the rivet of the normally open spring.

Also, current latching magnetic relay typically have relay motors, which generate a rotational movement. Center contact springs typically require only a linear movement in the actuator assembly to bring it into contact with the opposite contact areas. Consequently additional parts are required in order to convert the rotational movement generated by the relay motor into a linear movement, adding to the expense of producing and assembling the latching magnetic relay.

Accordingly, there is also a need for a small latching magnetic relay with a motor that generates a linear movement to accommodate contact assemblies, which require only a linear movement while utilizing a pressure spring for the center contact spring.

Accordingly, there is also a need for a latching magnetic relay with a contact assembly comprised of more conductive material than brass and bronze and having a greater contact surface between the springs and terminals.

As will be described in greater detail hereinafter, the present invention solves the aforementioned and employs a number of novel features that render it highly advantageous over the prior art.

SUMMARY OF THE INVENTION

Accordingly, it is an object of this invention to provide an electromagnetic relay that is small in size yet capable of handling high switching and operating current.

It is a further object of this invention to provide an electromagnetic relay with a larger contact gap.

It is a still further object of this invention to provide an electromagnetic relay that meets the requirements for large contact gas of VDE, TUV and other certifying agencies when the relay is used for certain applications.

It is a further object of this invention to provide for high voltage DC switching.

It is a still further object of the present invention to provide an electromagnetic relay with a contact assembly comprised of more conductive material than brass and bronze and having a greater contact surface between the springs and the terminals while utilizing pressure springs to prevent pre bending of the center contact spring.

To achieve these objectives, and in accordance with the purposes of the present invention the following electromagnetic relay is presented.

The electromagnetic relay has a motor assembly with a core connected to a frame. A relay coil is wound outside the core, the core has a core end extends from the relay coil.

An armature has a first armature end, a second armature end and an armature elbow. The armature elbow engages the top of the frame and remains engaged to the top of the frame by way of an armature retaining spring. The first armature end magnetically engages the core end when the relay coil is energized.

A first actuator end of an actuator engages the armature at the second armature end. The second actuator end engages a plurality of center contact springs.

A center contact spring assembly is comprised of a center contact spring, a contact button (single or double headed), and a center terminal. The center terminal is ultrasonically metal-to-metal welded onto the center contact spring. The center contact spring is formed straight without pre bending. Each center contact spring has a first contact rivet. The first contact rivet extends through the center contact spring and has a first contact surface on one side of the center contact spring and a second contact surface on the other side of the center contact spring. A slot can be cut through the center contact spring in order to reduce the cross section of the spring, allowing lower electrical power consumption of the relay coil, but also reduces the switching and operating current. Excellent results are also obtained without providing a slot on the center contact spring.

A normally open contact spring assembly is comprised of a normally open spring, a contact button (single headed only), and a normally open terminal. The normally open spring is ultrasonically metal-to-metal welded onto the normally open terminal. A normally open spring is positioned relatively parallel to a center contact spring. The normally open spring is curl shaped to be sized and fitted within the housing, and to increase the length of the normally open spring for flexibility (see formula on 21 and 22). The normally open spring has a second contact rivet, the second contact rivet positioned opposing the first contact surface of the first contact rivet. The height of the second contact rivet may differ dependent upon the contact gap requirement for the particular relay. A slot can be cut through the normally open spring in order to reduce the cross section of the spring, allowing lower electrical power consumption of the relay coil, but also reducing the switching and operating current. The normally open spring is ultrasonically metal-to-metal welded onto a normally open terminal to form a normally open contact spring assembly.

A normally closed contact spring assembly is comprised of a normally closed spring, a contact button (single headed only), and a normally closed terminal. The normally closed terminal is ultrasonically metal-to-metal welded onto the normally closed spring. A normally closed spring is positioned relatively parallel to a center contact spring. The normally closed spring is curl shaped to be sized and fitted within the housing, and to increase the total length of the normally closed spring for flexibility. The normally closed spring has a third contact rivet, the third contact rivet positioned opposing the second contact surface of the first contact rivet. The height of the third contact rivet may differ dependent upon the contact gap requirement for the particular relay. The normally closed spring is ultrasonically metal-to-metal welded onto a normally closed terminal to form a normally closed contact spring assembly. The normally closed contact spring assembly is vertically positioned with respect to a center contact spring so that the third contact rivet is in contact with the second contact surface when the center contact spring is not being acted upon by the actuator and the pressure spring.

When energized, the terminals of the relay coil accept a current that runs throughout the relay coil causing a magnetic field that magnetizes the core. The magnetic force then draws the first armature end into contact with the core end causing the actuator to apply a force on the center contact spring which bends the center contact spring breaking contact with the rivet of the normally closed spring and establishing contact with the rivet of the normally open spring. The normally closed spring is ultrasonically metal-to-metal welded onto the normally closed terminal to form a normally closed contact spring assembly.

A pressure spring is positioned above the center contact spring to apply pressure to the center contact spring onto the normally closed spring. The pressure spring comprises a retaining end for engaging and a pressure end for applying pressure to the center contact spring.

When the relay coil is not energized the armature is disengaged from the core end and no force is applied to the center contact spring from the actuator. The center contact spring returns to its original position, reestablishing contact with the third contact rivet of the normally closed spring.

In an alternative embodiment, the present invention is driven by the movement of pole pieces in response to the polarity of a current running through the excitation coil. A linear movement occurs when the polarity of the current running through the excitation coil causes the magnetic flux in the ferromagnetic system to induce first and second pole pieces to magnetically couple to the contact sections opposite the contact section that they were previously magnetically coupled to.

The resulting linear movement of the pole pieces is translated into a linear movement of the actuator assembly.

This linear movement of the actuator assembly either drives the center contact spring into contact with a pair of contact areas positioned on opposite sides of the center contact spring, or drives the center contact spring into breaking contact with the contact areas of either the second contact rivet or the third contact rivet.

The present invention has advantages that permit the device to successfully transfer higher currents while maintaining a relatively small overall package size. The present invention also provides for a 1.5 mm resp. 3.0 mm contact gap, which is required by VDE, TUV and other certifying agencies when the relay is used for certain applications. The present invention further provides for a large contact gap, which is also desirable for high voltage DC switching. First, the center contact springs and the normally open springs are made from a high current conductive copper alloy with maximum spring properties, and the center contact terminals and the normally open terminals are made from pure copper materials, which are more conductive than those typically used in the prior art. Second, the use of ultrasonic metal-to-metal welding technique increases the contact areas between the springs and the terminals allowing a greater current flow between the springs and the terminals. Third, a number of pressure springs eliminate pre bending of the center contact springs, allowing for a thicker contact spring (see formula on page 21 and 22), and therefore, allowing for a higher switching and operating current, a larger contact gap, and a prolonged relay life. Fourth, the larger contact gap meets requirement of VDE, TUV and other certifying agencies when the relay is used for certain applications. Fifth, a larger contact gap is desirable for higher voltage DC switching.

DESCRIPTION OF THE PREFERRED EMBODIMENT

The present invention is an electromagnetic relay which has a contact assembly capable of handling current switching operations with higher current flow while maintaining a small overall package size and without pre bending a center contact spring. The relay of the present invention is capable of accepting an all-or-nothing DC, or an all-or-nothing AC motor, or a polarized magnetic latching motor as described in U.S. Pat. No. 6,046,660 issued on Apr. 4, 2000. The latching motor is adapted to the size and typical characteristics of the invention.

Figure 1:
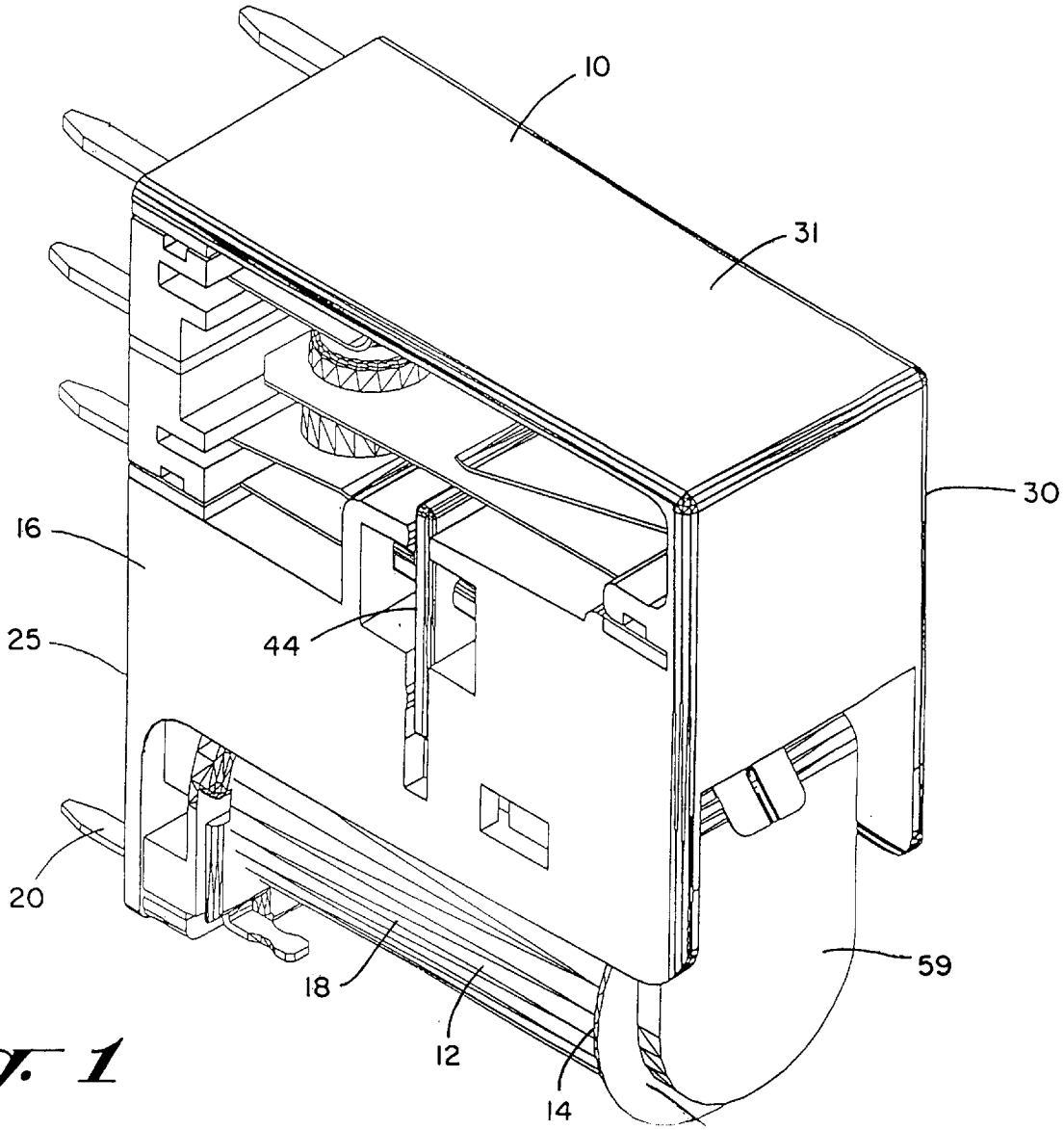
FIG. 1 is an isometric view of a one change over (SPDT) electromagnetic relay constructed in accordance with the principals of the present invention wherein the electromagnetic relay device is in an opened position illustrating important features of the invention.
Figure 2:
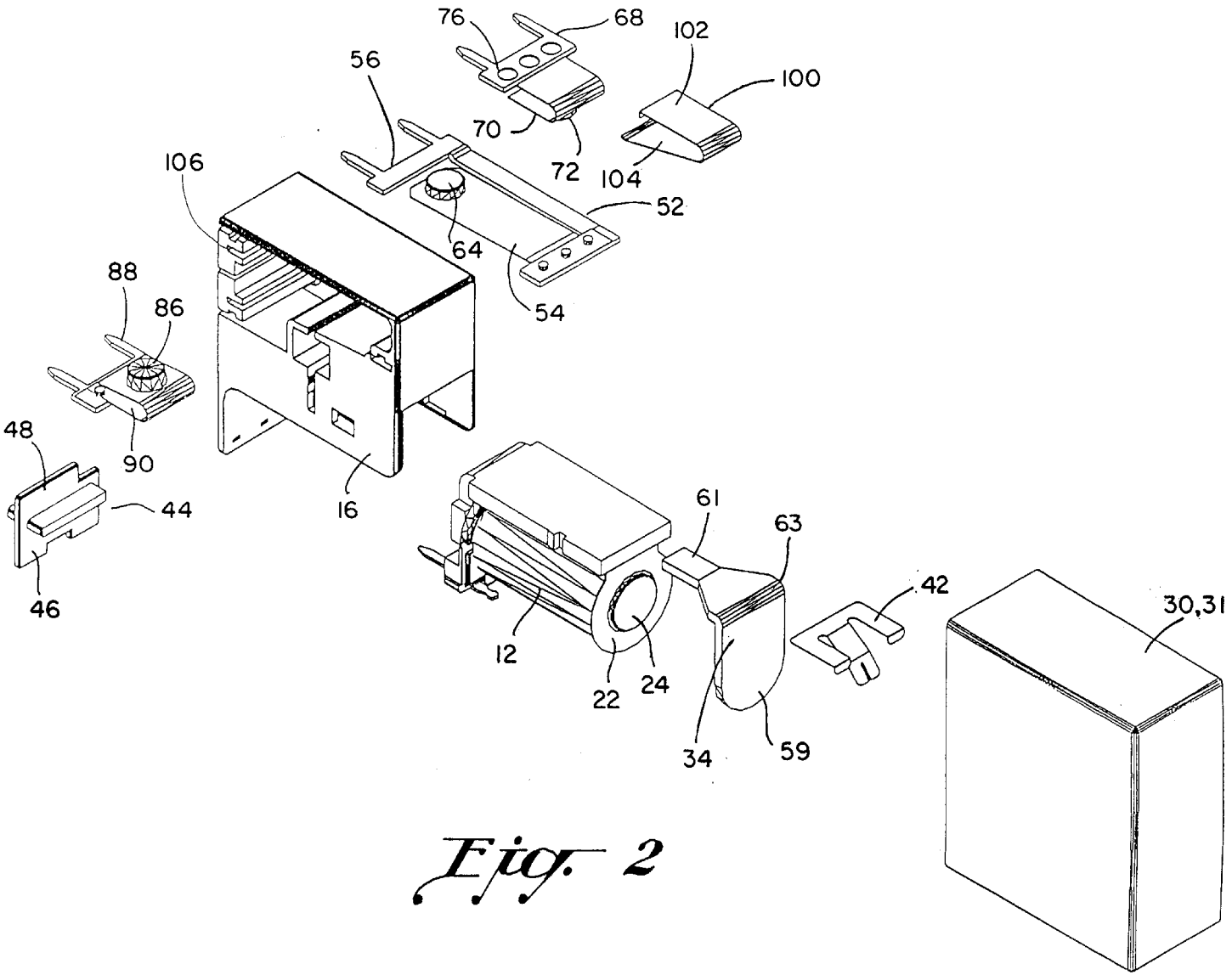
FIG. 2 is an exploded view of the one change over (SPDT) electromagnetic relay constructed in accordance with the principals of the present invention wherein the electromagnetic relay device illustrates important features of the invention such as the center contact spring assembly, the normally closed contact spring assembly, the normally open contact spring assembly, and the pressure spring.
Figure 3:
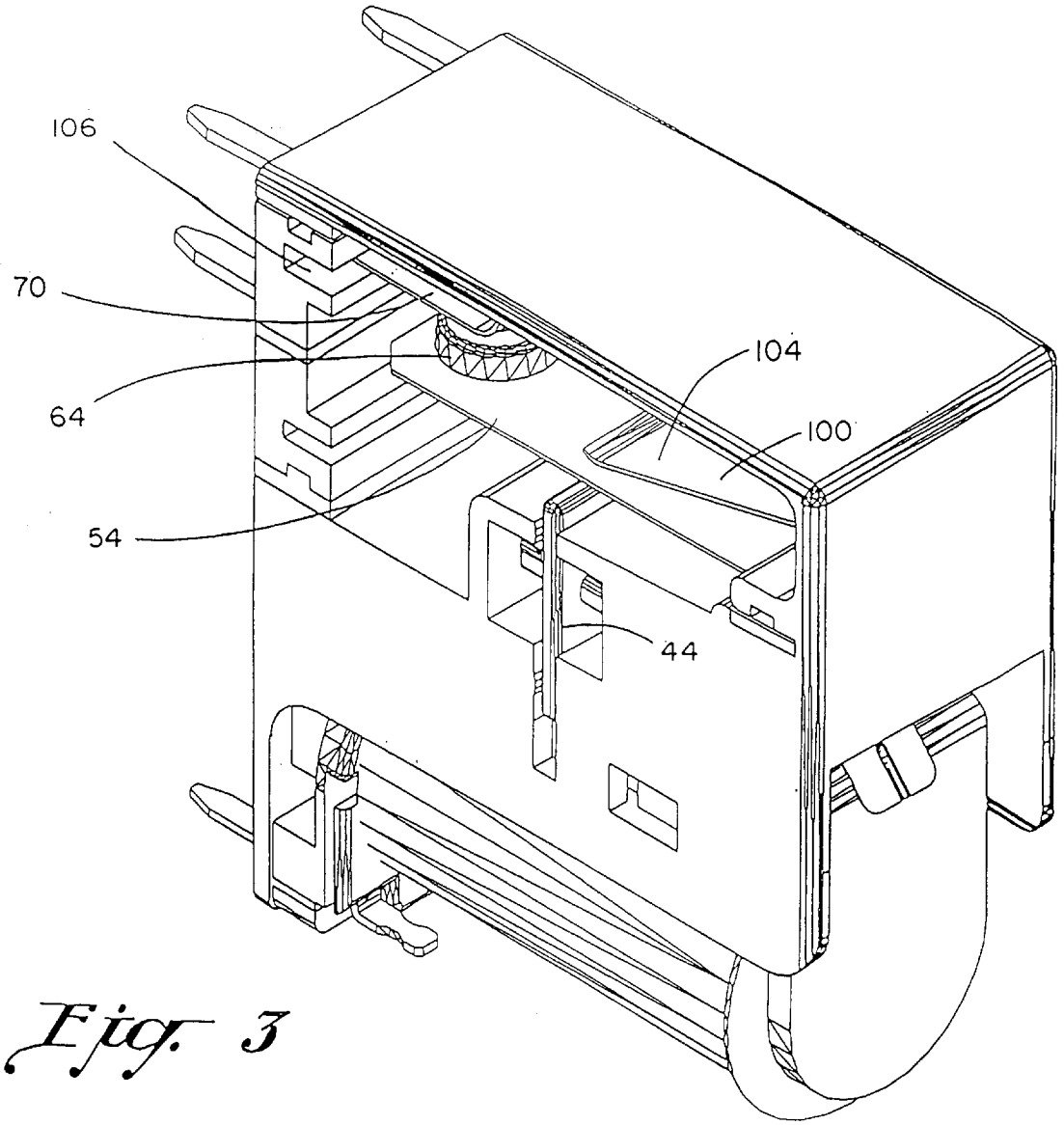
FIG. 3 is an isometric view of single pole normally open embodiment (SPST-NO) wherein components are shown.
Figure 4:
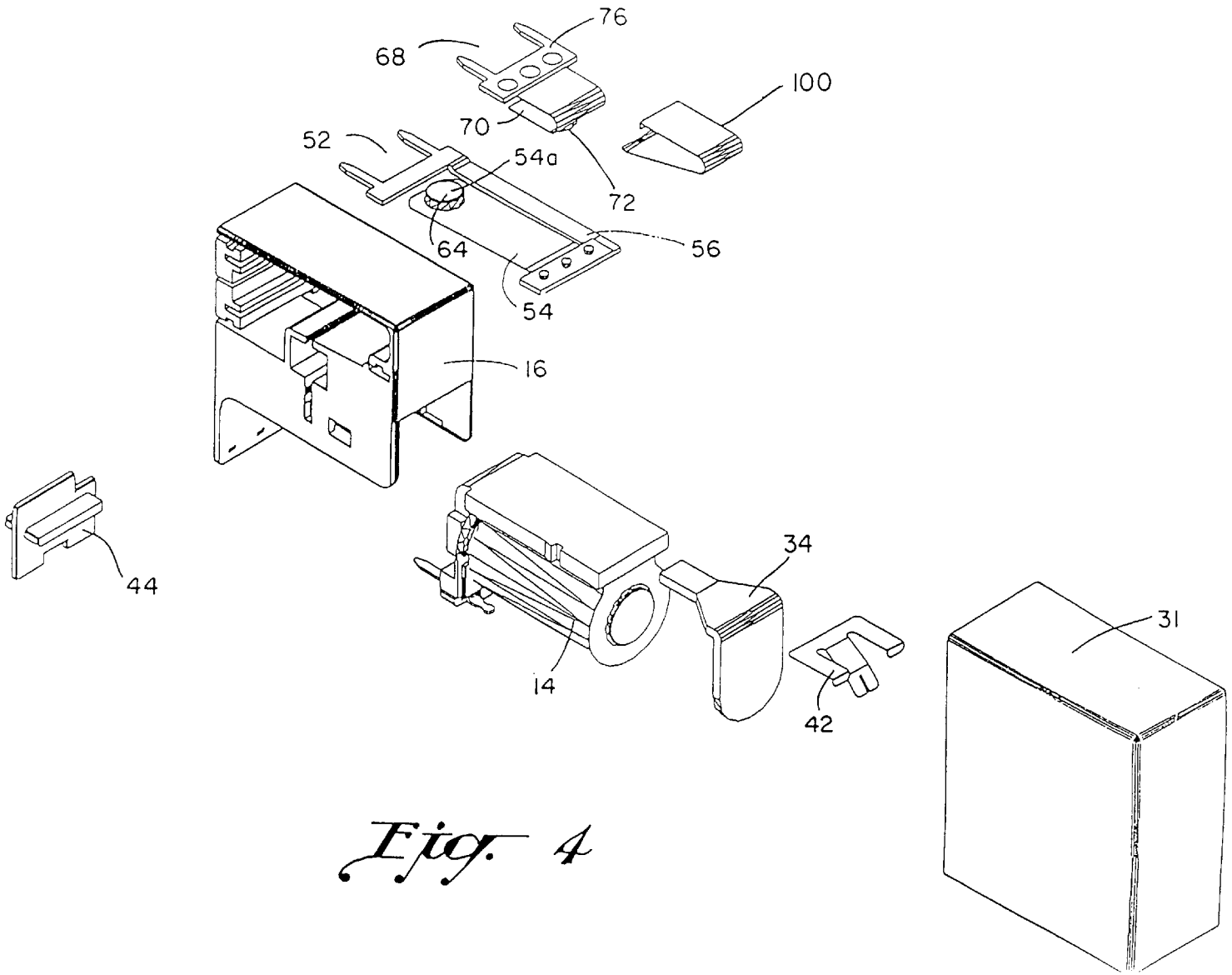
FIG. 4 is an exploded view of FIG. 3.
Figure 5:
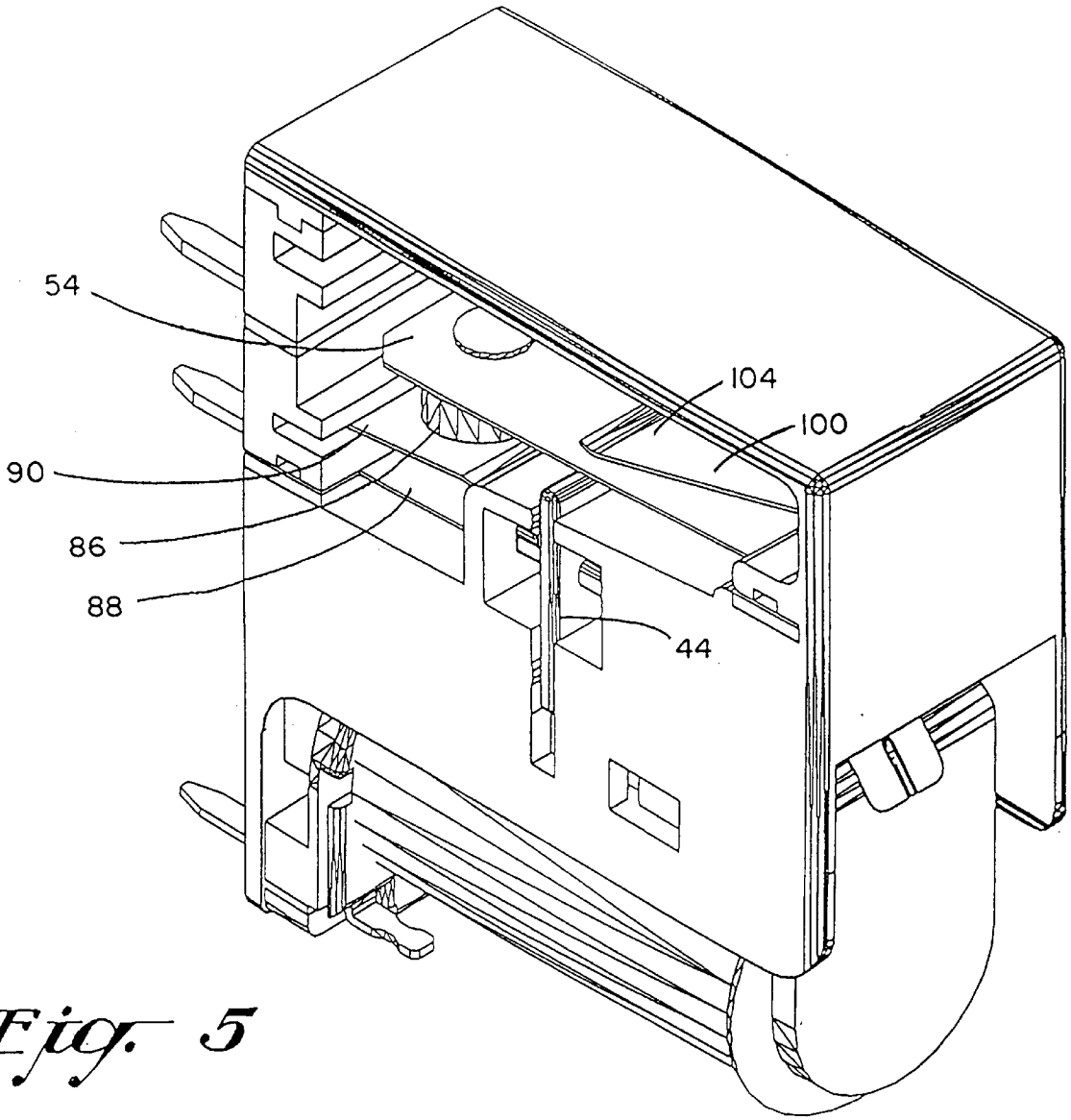
FIG. 5 is an isometric view of the single pole normally closed embodiment (SPST-NC) wherein the normally closed contact spring assembly is shown.
Figure 6:
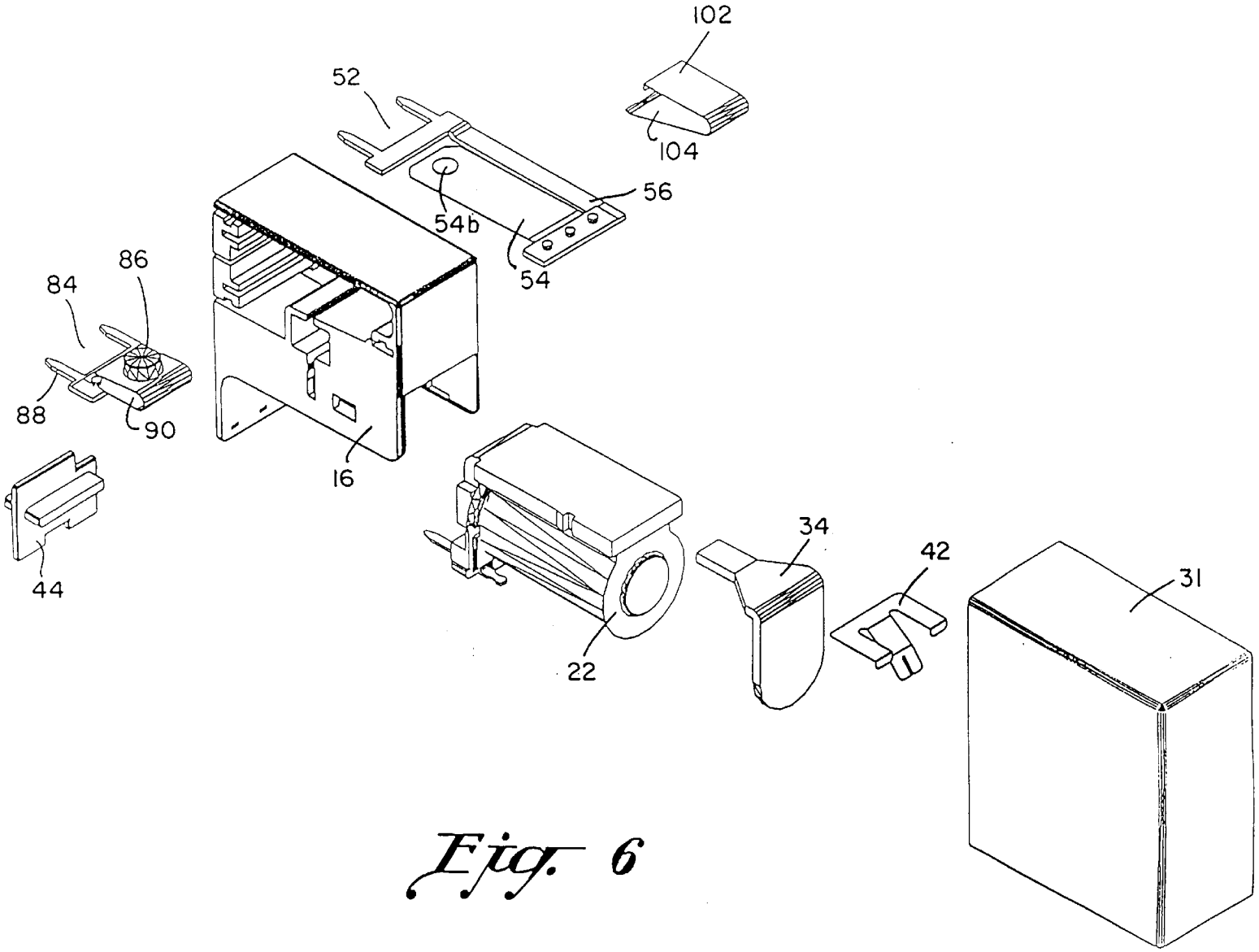
FIG. 6 is an exploded view of FIG. 5.
Figure 7:
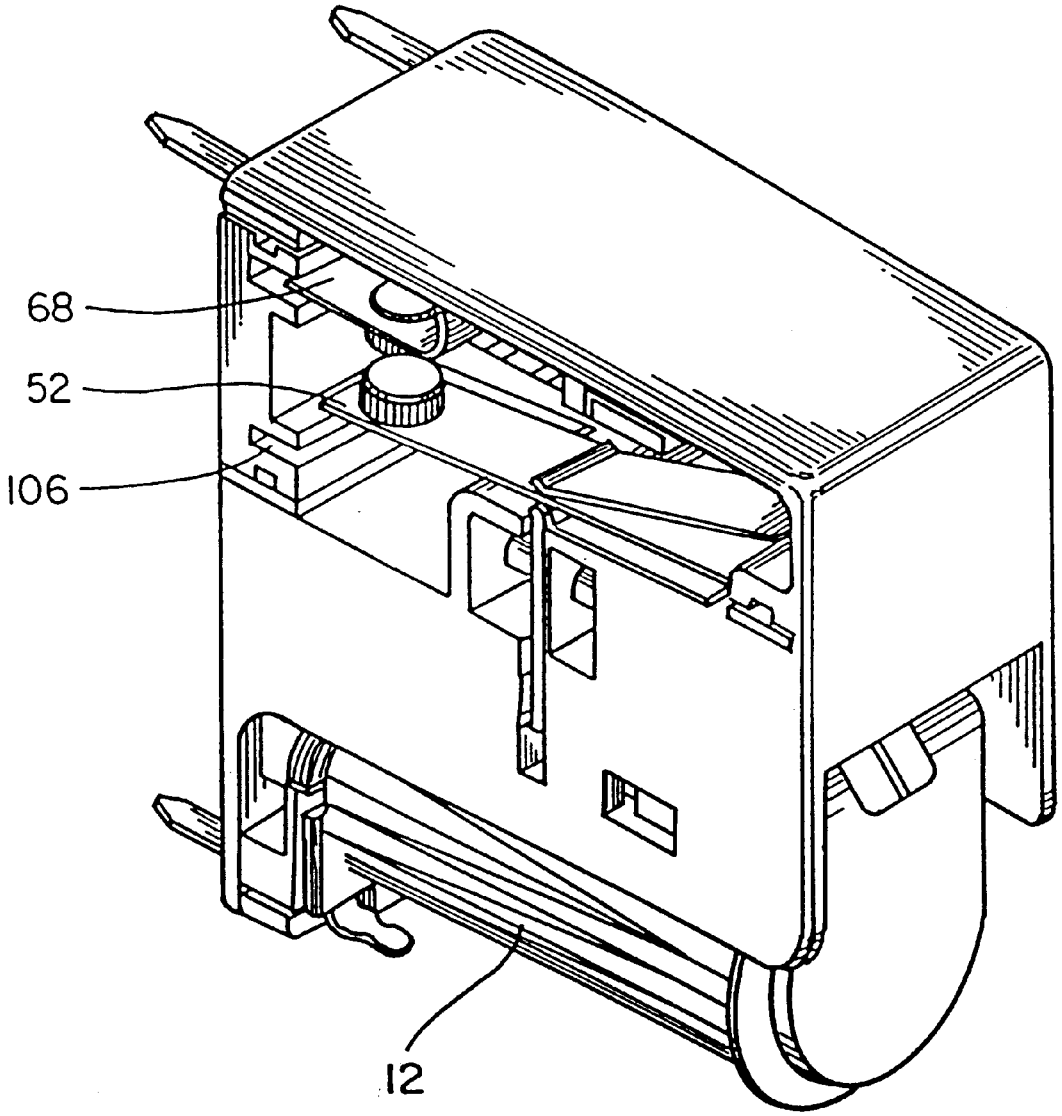
FIG. 7 is an isometric view of the double make embodiment (DM) with 3.0 mm (2×1.5 mm) contact gap.
Figure 8:
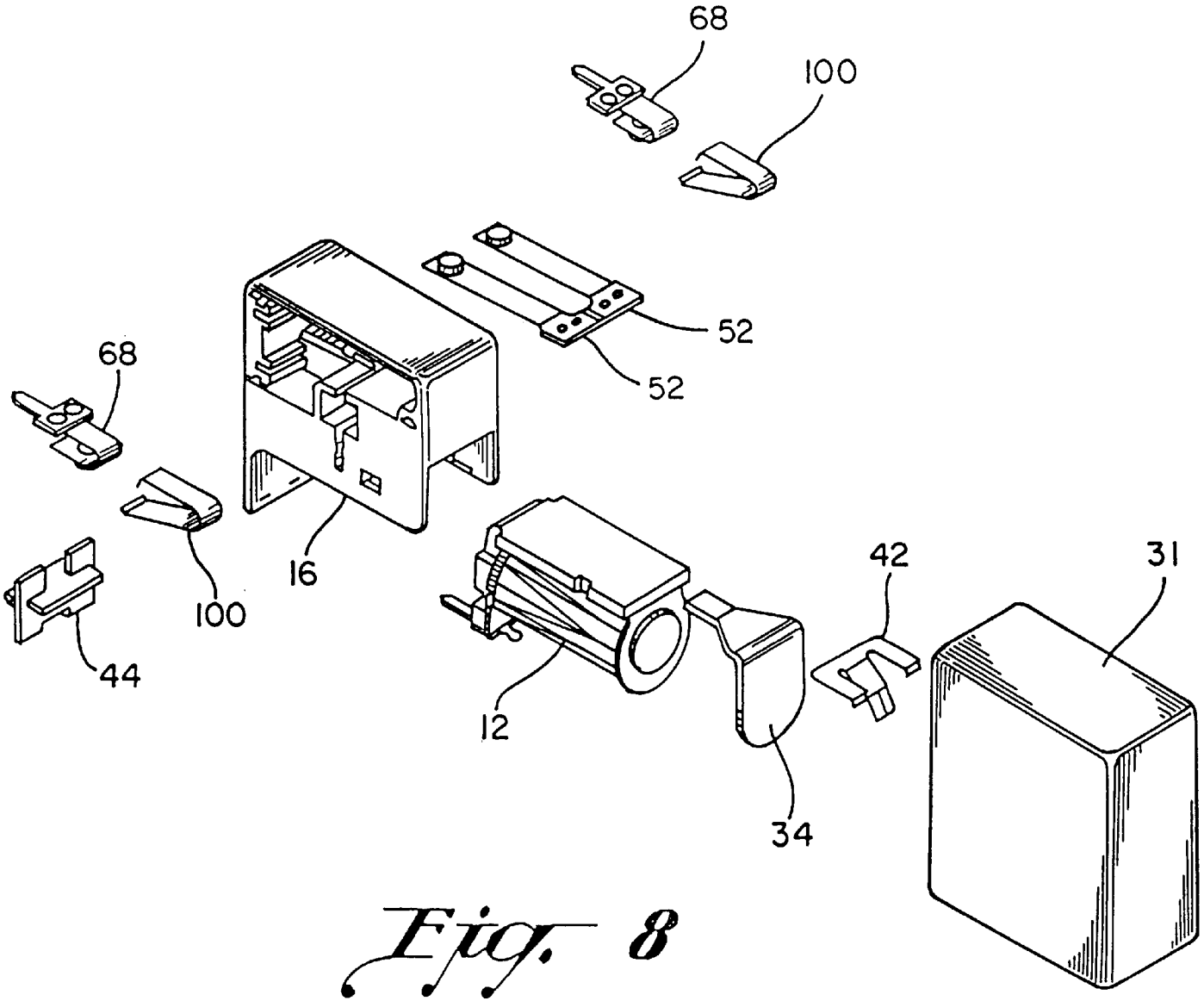
FIG. 8 is an exploded view of FIG. 7.
Figure 9:
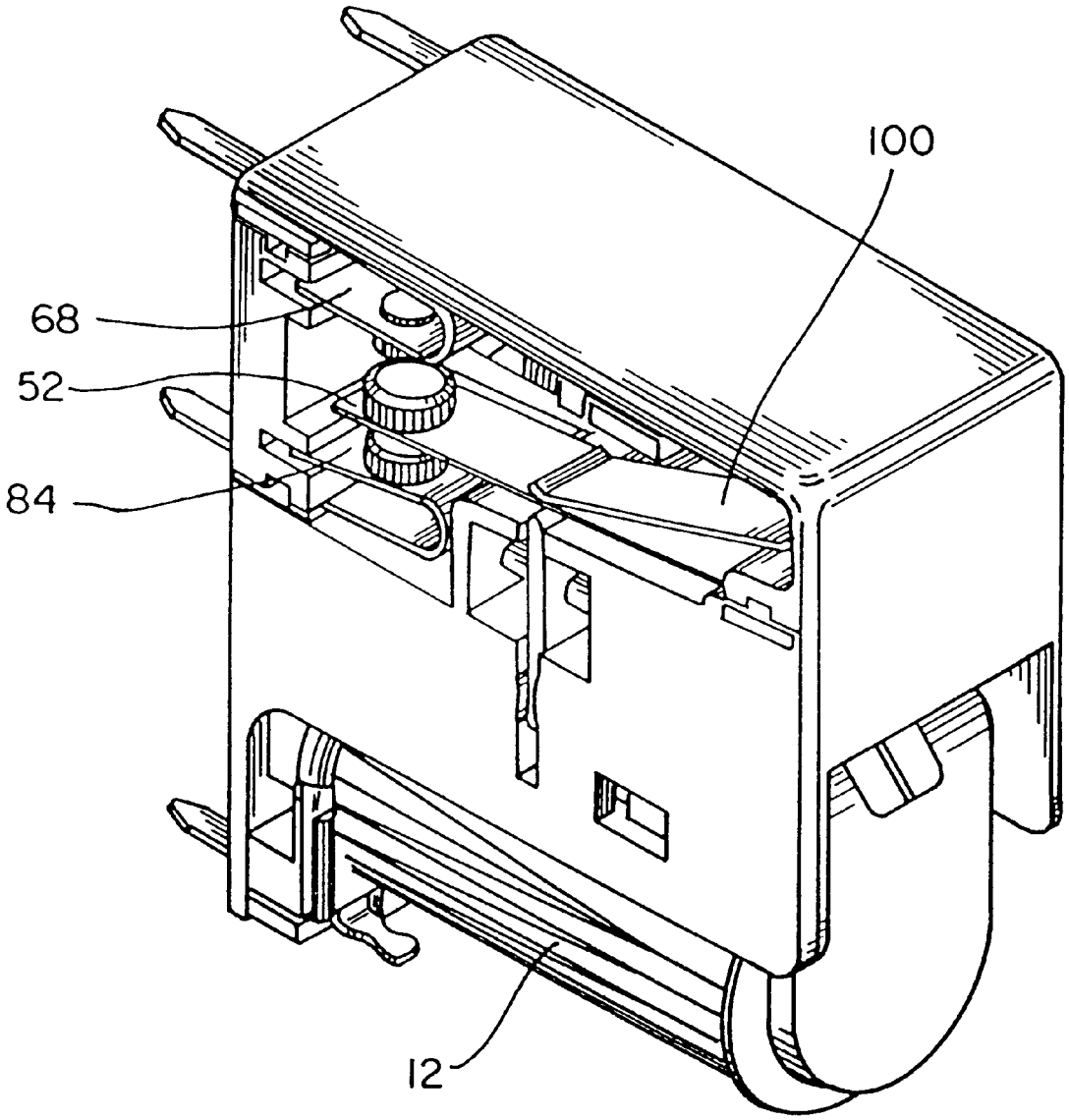
FIG. 9 is an isometric view of the double break-double make embodiment (DB-DM) with 3.0 mm (2×1.5 mm) contact gap.
Figure 10:
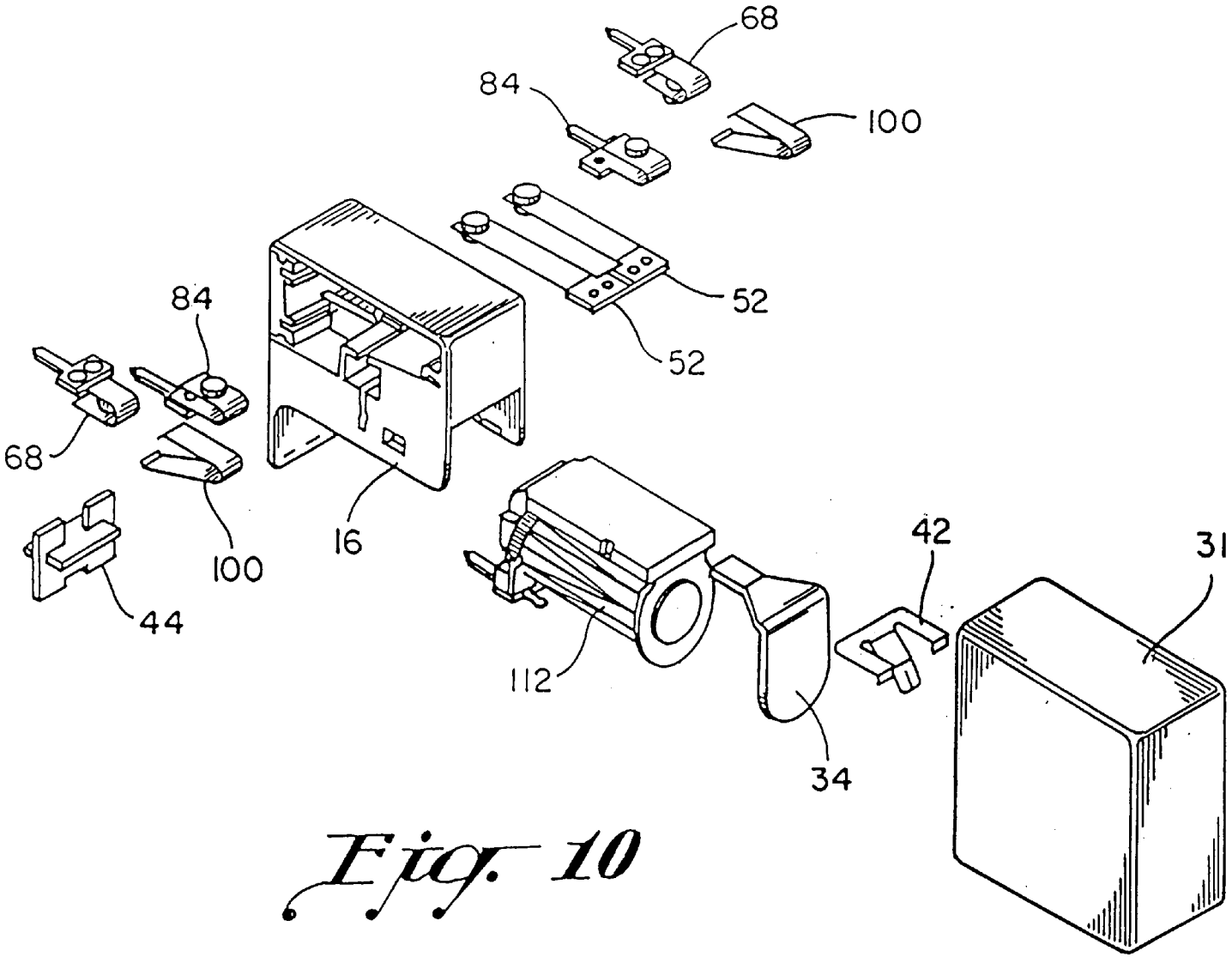
FIG. 10 is an exploded view of FIG. 9.
Figure 11:
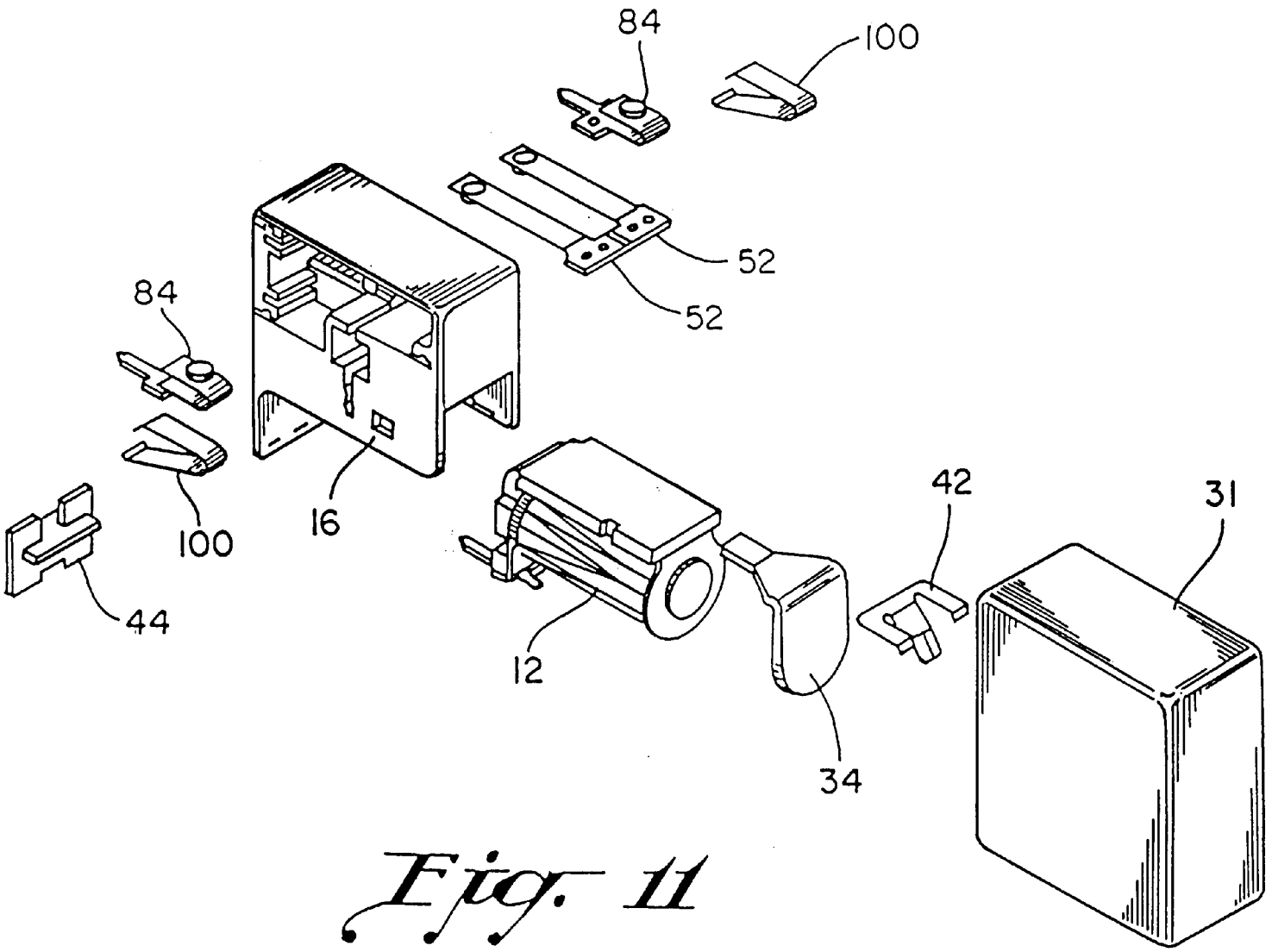
FIG. 11 is an exploded view of the double break embodiment (DB) with 3.0 mm (2×1.5 mm) contact gap.
Figure 12:
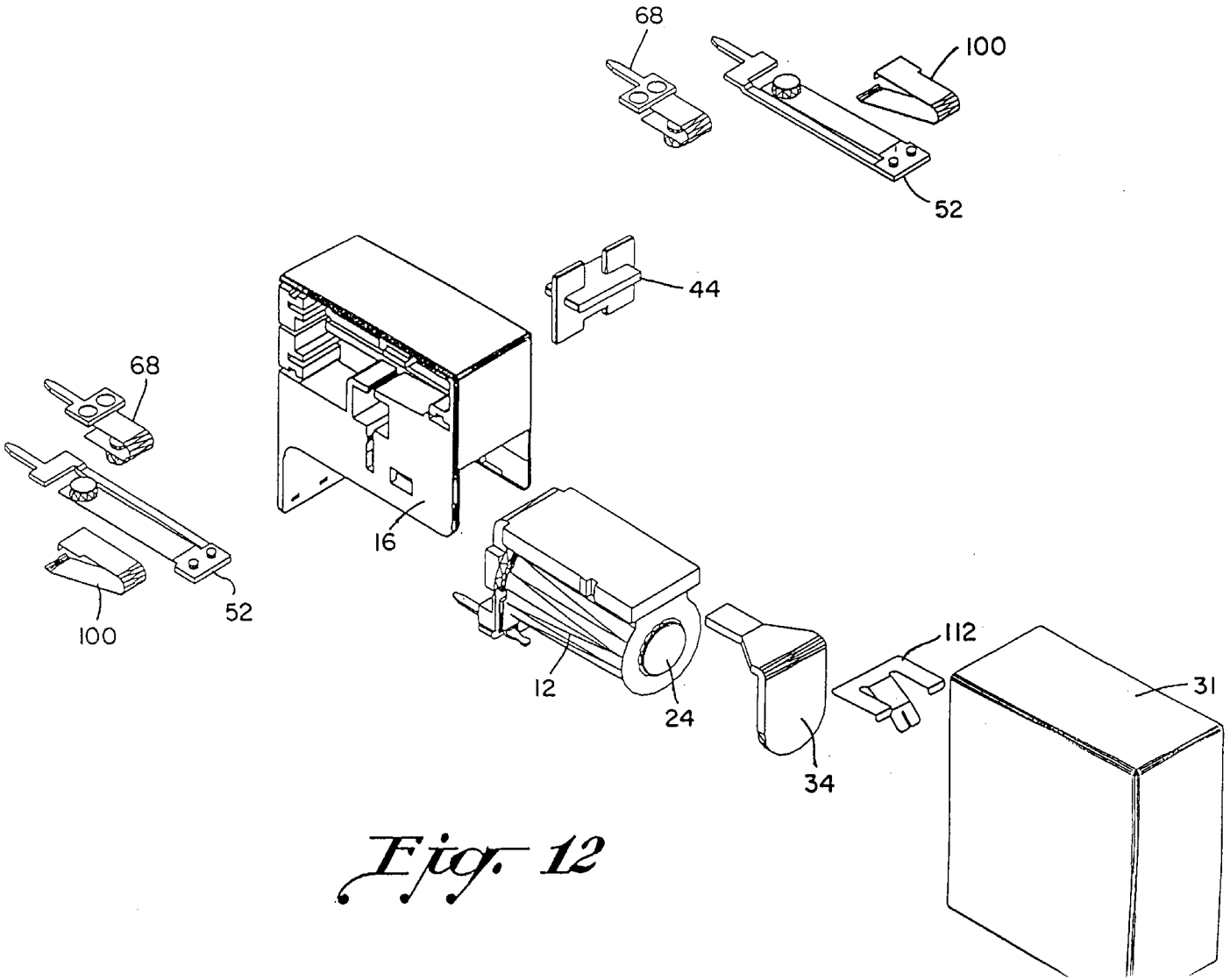
FIG. 12 is an exploded view of the double pole-single throw normally open (DPST-NO) embodiment.
Figure 13:
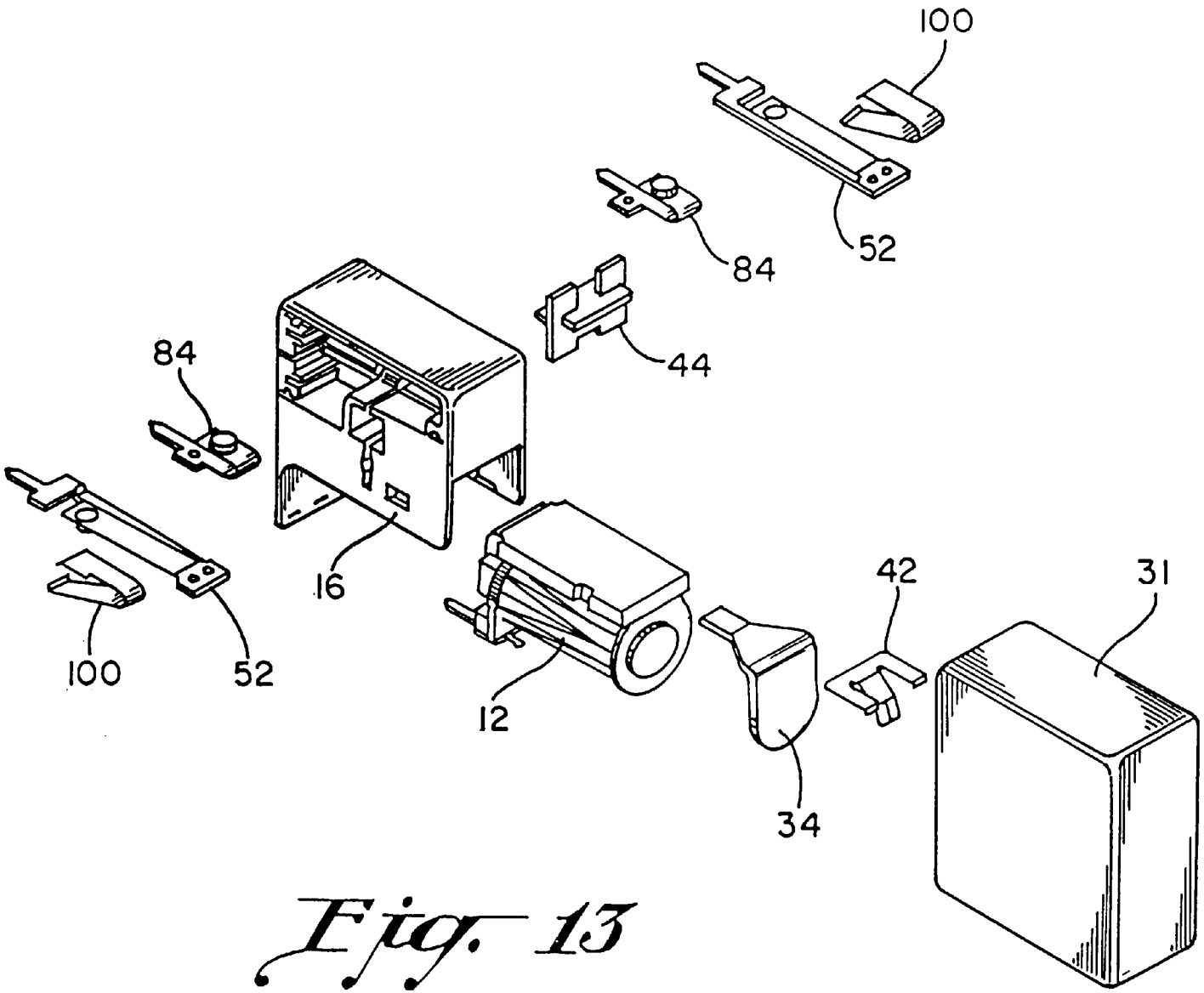
FIG. 13 is an exploded view of the double pole-single throw normally closed (DPST-NC) embodiment.
Figure 14:
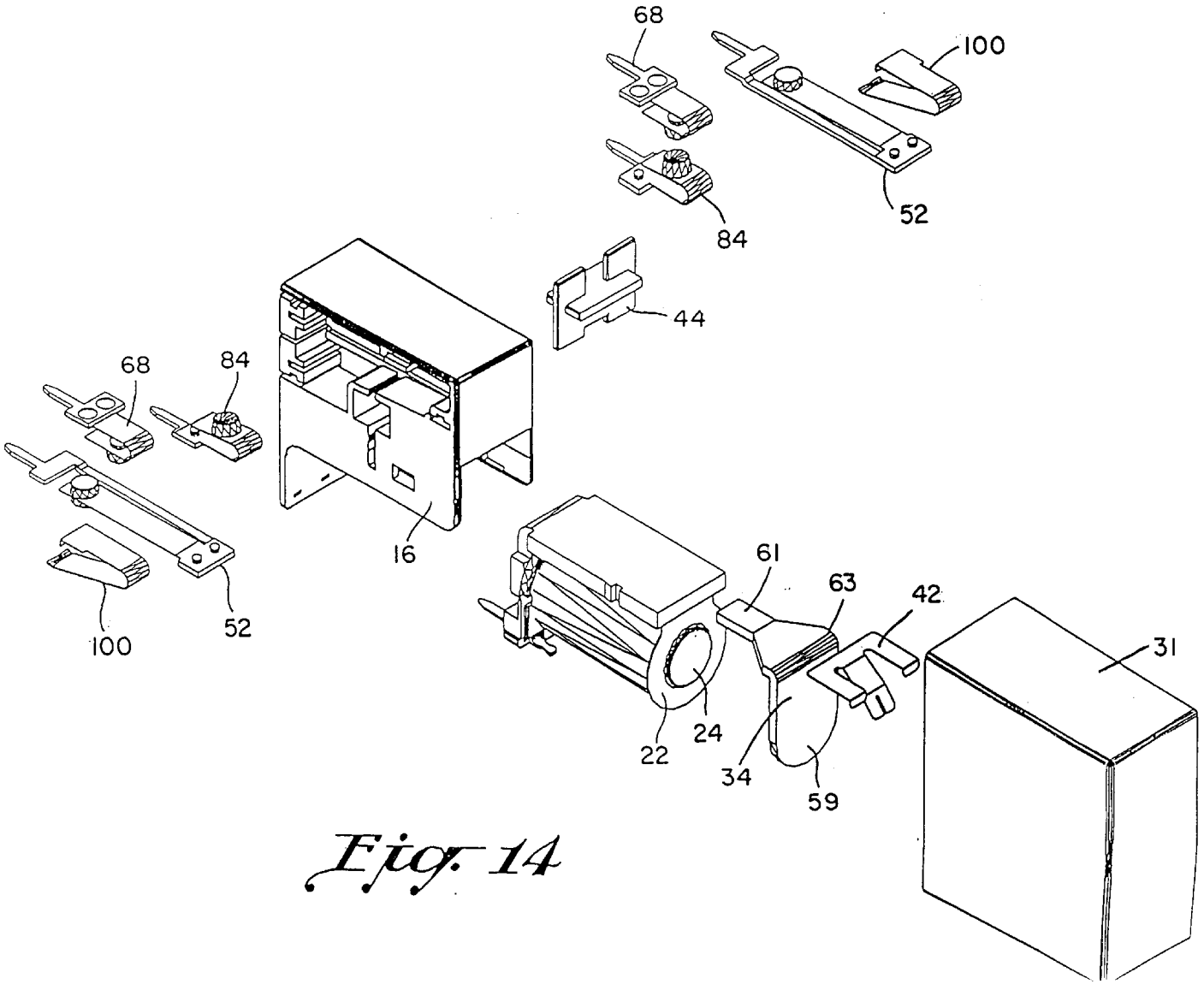
FIG. 14 is an exploded view of the two change over (DPDT) embodiment.

Referring to FIGS. 1, 2, 3, 4, 5, 6, and 20, the electromagnetic relay 10 has a motor assembly 12 with a bobbin 14 secured to a frame 16. The motor assembly 12 can be driven by either DC operation or AC operation. In the preferred embodiment, the bobbin 14 is made from a thermoplastic material. The bobbin 14 is wound with a copper wire producing a relay coil 18. A plurality of terminals 20 are pressed into the bobbin 14. The ends of the copper wire are attached to the terminals 20. A core 22 is adjacently connected below the bobbin 14 except for a core end 24 which extends from the bobbin 14. The core 22 is made of a magnetic material as shown in FIG. 2.

Figure 21:
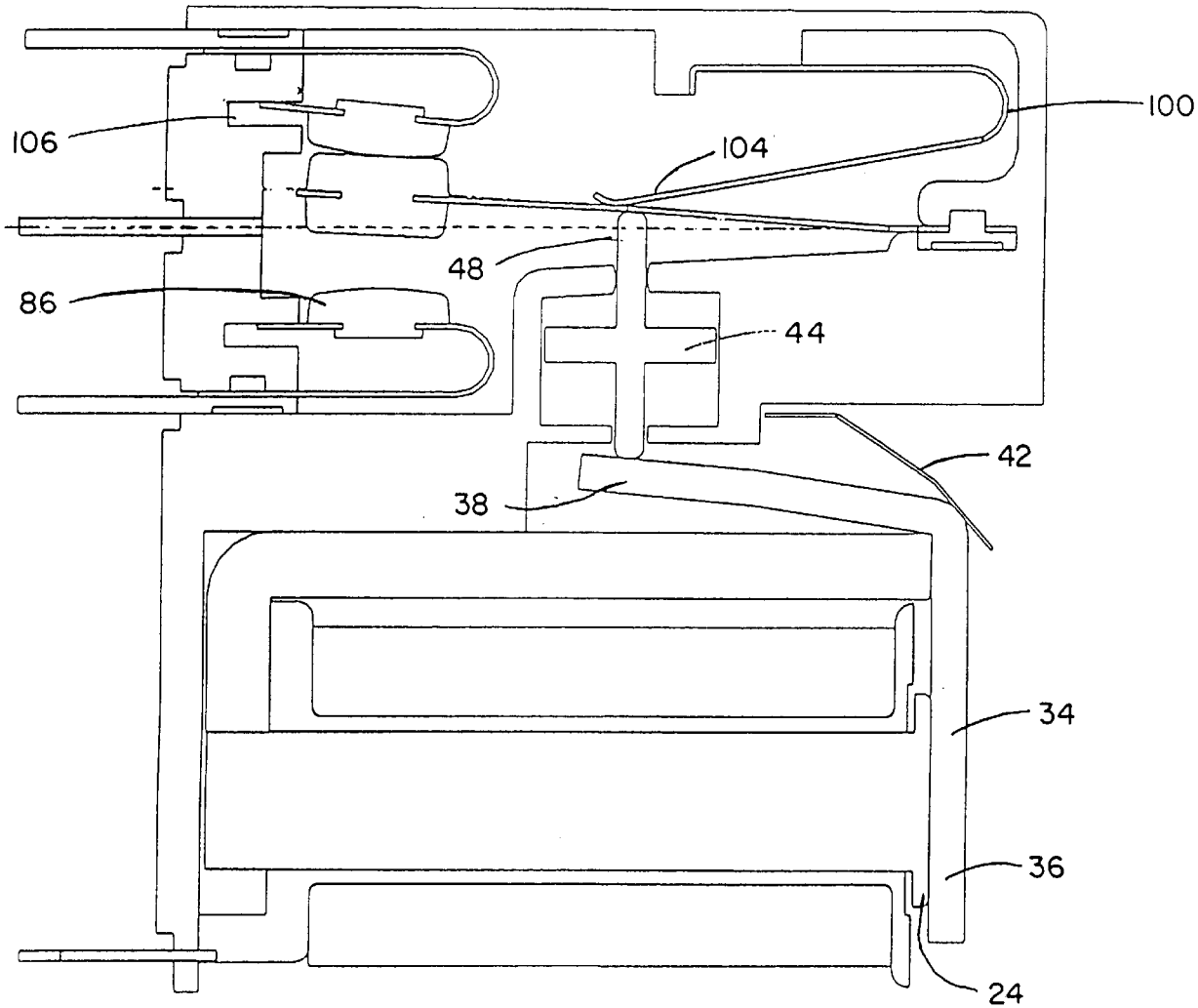
FIG. 21 is a side view of the housing showing the armature and the core end without an air gap, the actuator in an up position, and the pressure spring.

Referring to FIG. 21, an armature 34 has a first armature end 36, a second armature end 38 and an armature elbow 40. The armature elbow 40 engages a top of the housing 41 and remains engaged to the top of the housing 41 by way of an armature retaining spring 42. The first armature end 36 magnetically engages a core end 24 when the coil 18 is energized as shown in FIG. 21. A first actuator end 46 of an actuator 44 engages the armature 34 at the second armature end 38. The second actuator end 48 engages a plurality of center contact spring assemblies 52.

Figure 26:
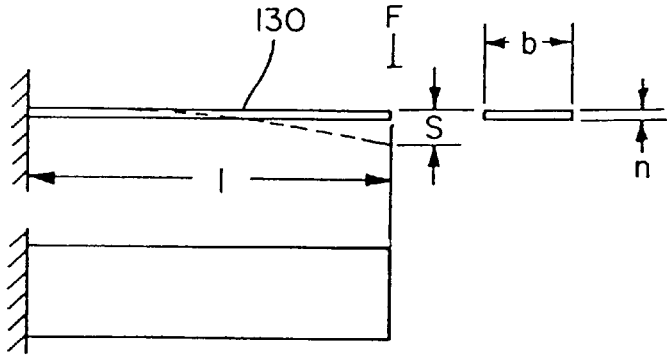
FIG. 26 is a demonstration view of a center contact spring with valuables for calculating different spring parameters.

Referring to FIG. 26, there is shown a spring 130 with a length of l, a width of b, and a thickness of h. A bending force $F_c$ can be calculated by using following formula:

$$\text{bending force } F_c[N] = \frac{s[\text{mm}] \times b[\text{mm}] \times h^3[\text{mm}^3] \times E[N/\text{mm}^2]}{4 \times l^3[\text{mm}^3]},$$

wherein s is spring deflection, and E is modulus of elasticity. A deflection s can be calculated by using following formula:

$$\text{deflection } s[\text{mm}] = \frac{4 \times F_c \times l^3[\text{mm}^3]}{b[\text{mm}] \times h^3[\text{mm}^3] \times E[N/\text{mm}^2]},$$

wherein $F_c$ is bending force, and E is modulus of elasticity. A permissible load $F_p$ can be calculated by using following formula:

$$\text{permissible load } F_p[N] = \frac{b[\text{mm}] \times h^2[\text{mm}^2] \times P_{bt}[N/\text{mm}^2]}{6 \times l[\text{mm}]},$$

wherein $P_{bt}$ is a permissible stress. A permissible deflection $s_p$ can be calculated by using following formula:

$$\text{permissible deflection } s_p[\text{mm}] = \frac{4 \times F_p \times l^3[\text{mm}^3]}{b[\text{mm}] \times h^3[\text{mm}^3] \times E[N/\text{mm}^2]},$$

wherein $F_p$ is a permissible load, and E is a modulus of elasticity. The permissible stress for copper alloy contact springs of the invention is 350 N/mm$^2$. The modulus of elasticity for copper alloy contact springs of the invention is 135,000 N/mm$^2$. The permissible force for steel springs of the invention is 1,000 N/mm$^2$. The modulus of elasticity for steel springs of the invention is 210,000 N/mm$^2$.

Figure 27:
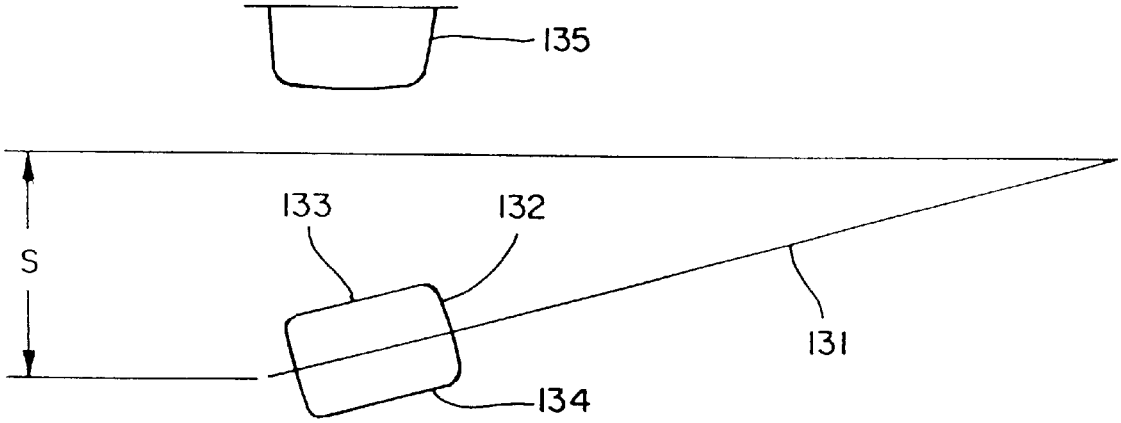
FIG. 27 is a side view of a traditional design embodiment of a center contact spring with a contact rivet and a normally open contact rivet at a pre-assembly stage.
Figure 28:
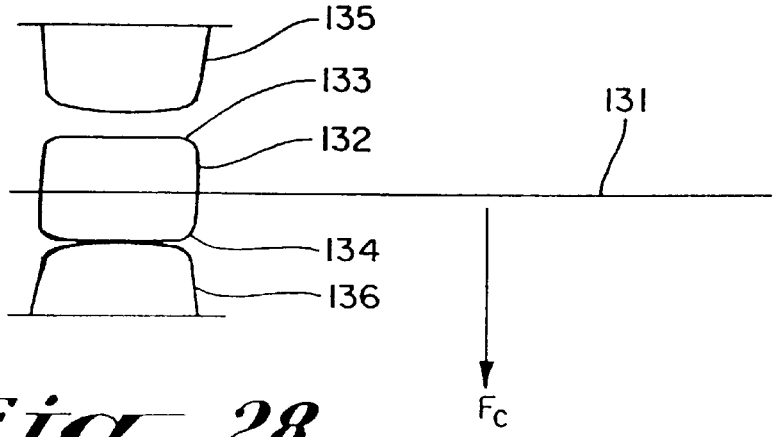
FIG. 28 is a side view of a traditional design embodiment of a center contact spring with a contact rivet, a normally open contact rivet, and a normally closed contact rivet.

Referring to FIGS. 27, 28, 29, and 30, there is shown a conventional relay using a center contact spring 131 with single headed contact buttons for normally closed and normally open contact springs. The center contact spring 131 shown in FIG. 27 is before pre bending. The center contact spring 131 has a first contact rivet 132. The first contact rivet 132 extends through the center contact spring 131 and has a first contact surface 133 on one side of the center contact spring 131 and a second contact surface 134 on the other side of the center contact spring 131. The center contact spring 131 is pre bent to achieve the necessary contact force $F_c$ and to hold the actuator in place of the relay where the pre bent center contact spring holds down above the actuator to contact the normally closed contact spring 136 as shown in FIG. 28. $F_c$ is the bending force of the center contact spring 131.

Figure 20:
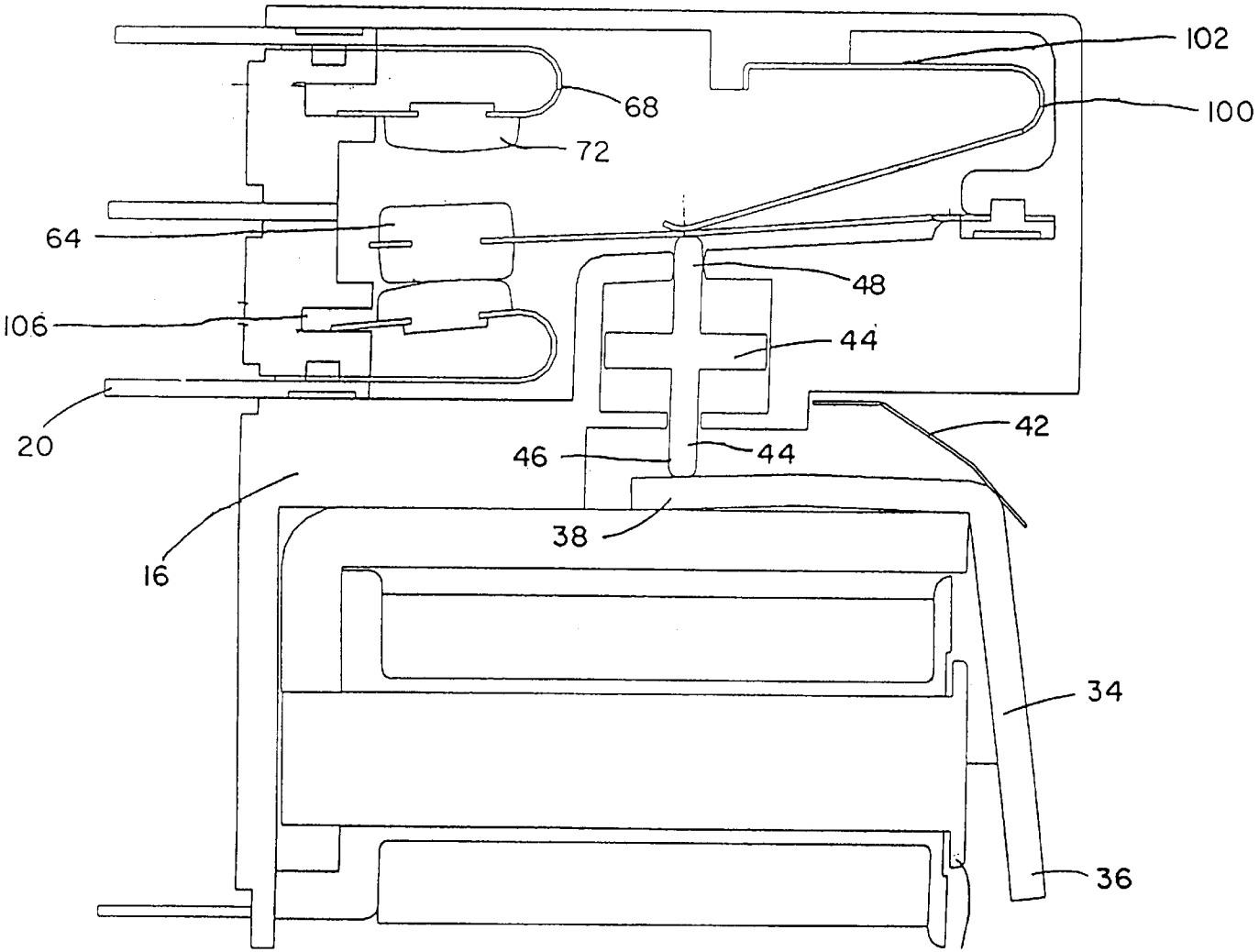
FIG. 20 is a side view of the housing showing the air gap between the armature and the core end, the actuator in a down position, and the pressure spring.
Figure 29:
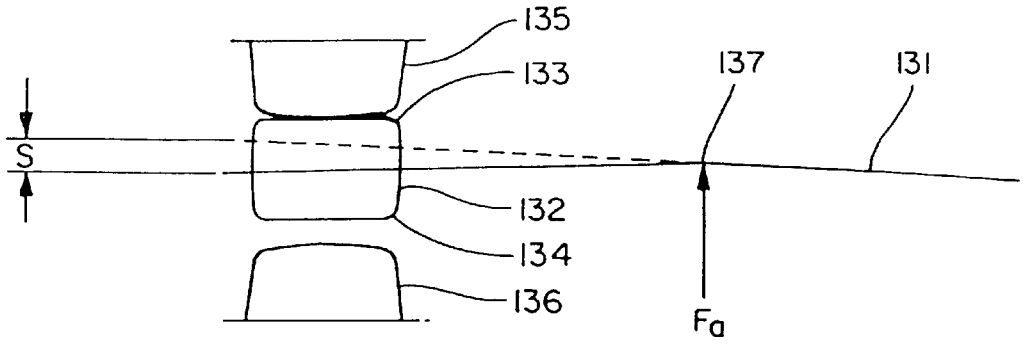
FIG. 29 is a side view of a traditional design embodiment of a center contact spring with a contact rivet, a normally open contact rivet, and a normally closed contact rivet, showing the overtravel of the center contact spring, when the relay is in operation.

Referring to FIGS. 20 and 29, the first contact rivet 132 of the center contact spring 131 is in touch with the second contact rivet 135. The relay is in operation at this time, and an actuator of the relay provides a force from actuator $F_a$ acting on the point 137 of the center contact spring 131. The s shows a partial spring deflection of the center contact spring 131.

Figure 30:
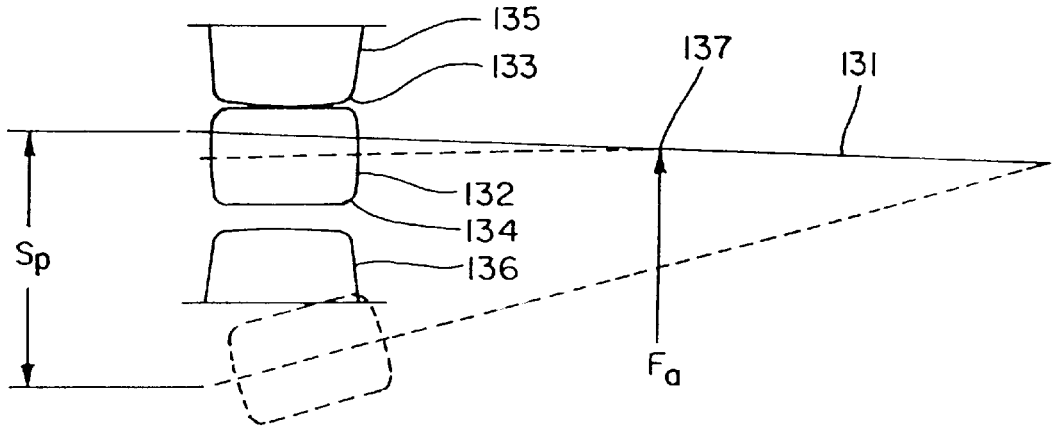
FIG. 30 is a side view of a traditional design embodiment of a center contact spring with a contact rivet, a normally open contact rivet, and a normally closed contact rivet, showing the overall deflection of the center contact spring, when the relay is in operation

Referring to FIGS. 21 and 30, it is shown the first contact rivet 132 of the center contact spring 131 in touch with the second contact rivet 135, when the center contact spring 131 is acted by the actuator 44 at point 137. $s_p$ in FIG. 30 represents the total deflection of the center contact spring 131.

Figure 23:
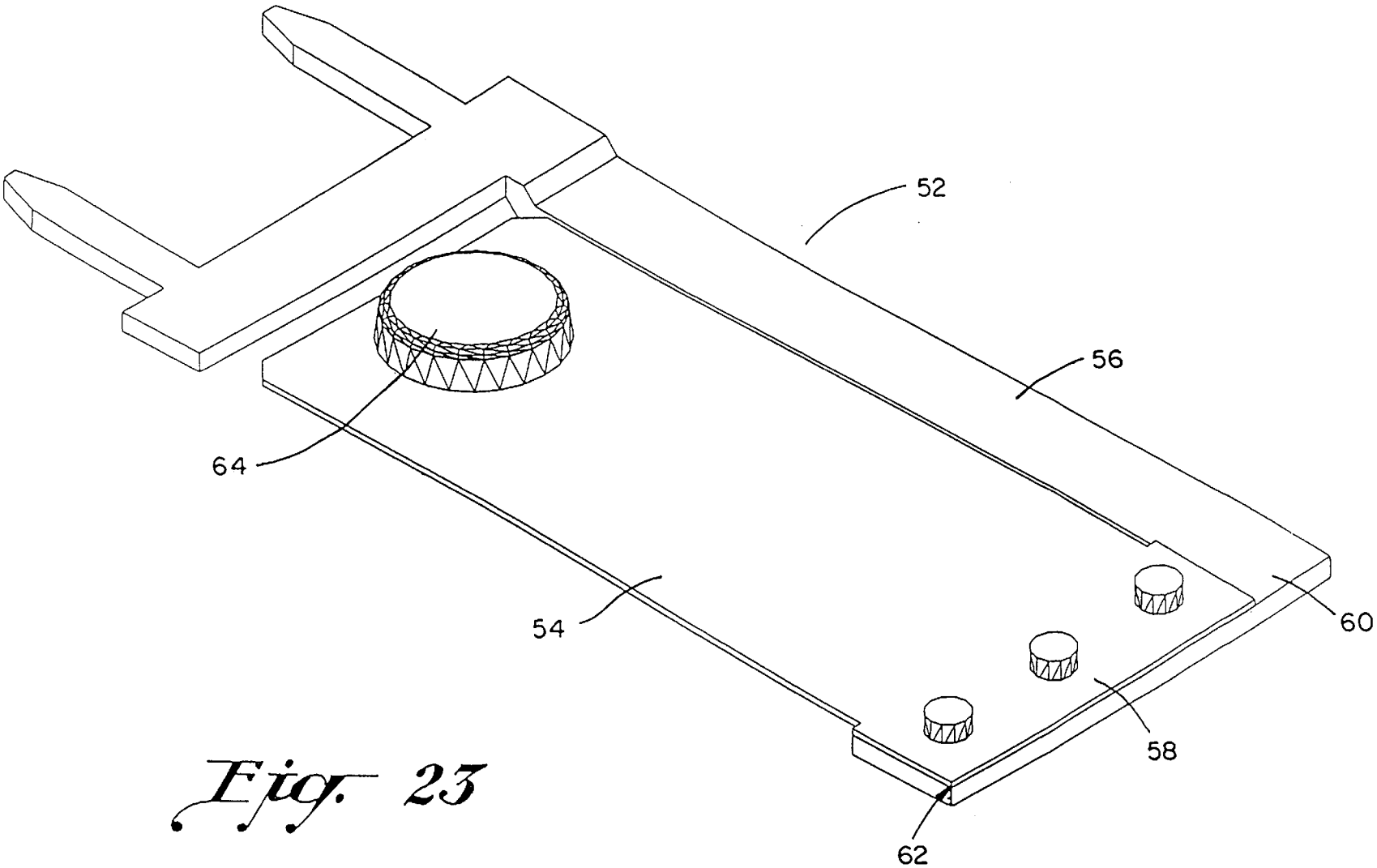
FIG. 23 is an isometric view of the center contact spring assembly in the single pole embodiment wherein components are shown.
Figure 25:
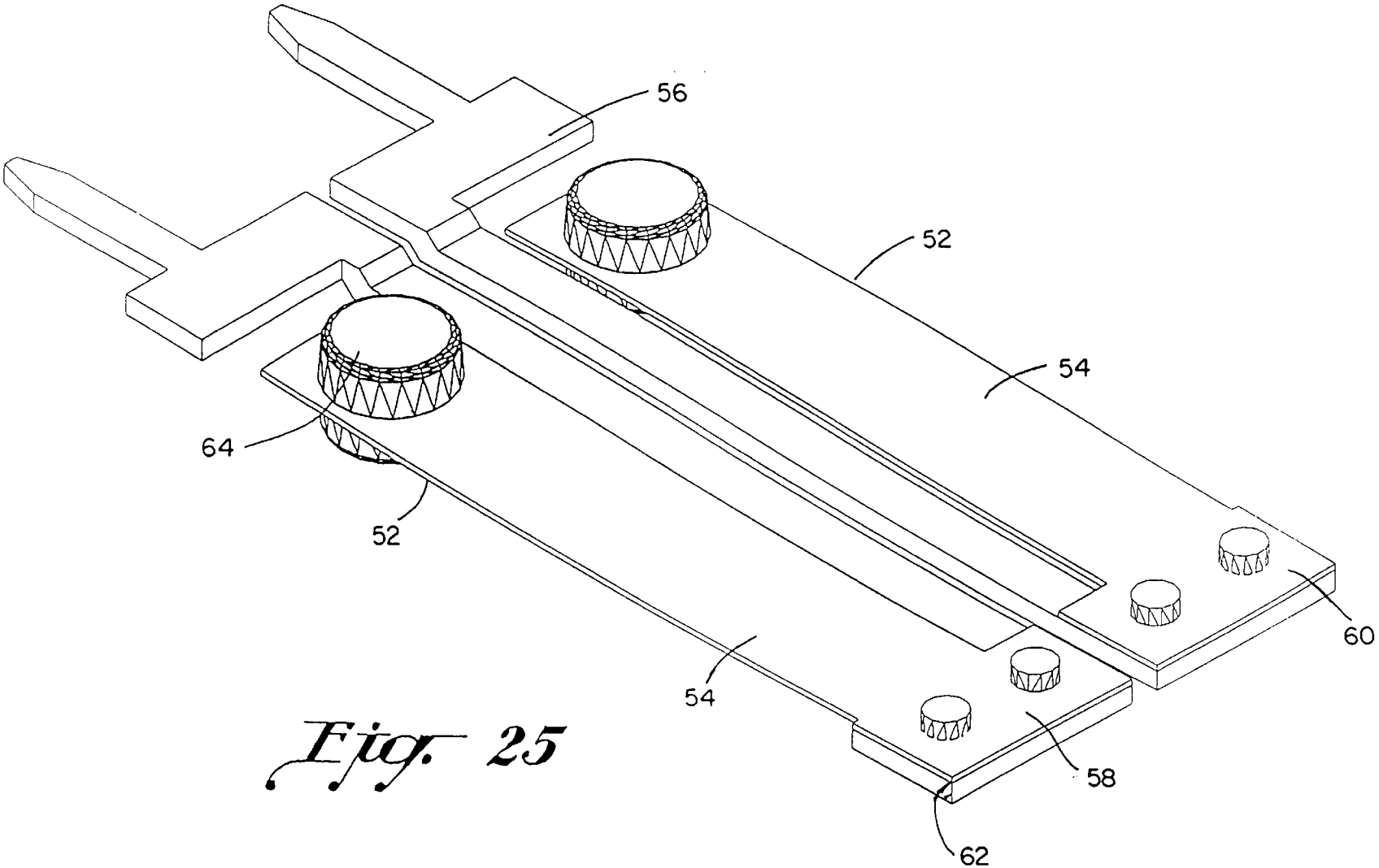
FIG. 25 is an isometric view of the center contact spring assemblies in the double pole embodiment wherein components are shown.

Referring to FIGS. 20, 23, and 25, each center contact spring assembly 52 is comprised of a center contact spring 54 ultrasonically metal-to-metal welded onto a center contact terminal 56. The center contact spring has a first planar shaped end 58 in which the first metal-to-metal welded end of 60 of the center contact terminal 56 is adjacently connected below. The first planar shaped end 58 and the first metal-to-metal welded end 60 are ultrasonically metal-to-metal welded together to form a first planar shaped weld 62. In the preferred embodiment, there can be a plurality of contact spring assemblies 52 in the electromagnetic relay 10.

Figure 24:
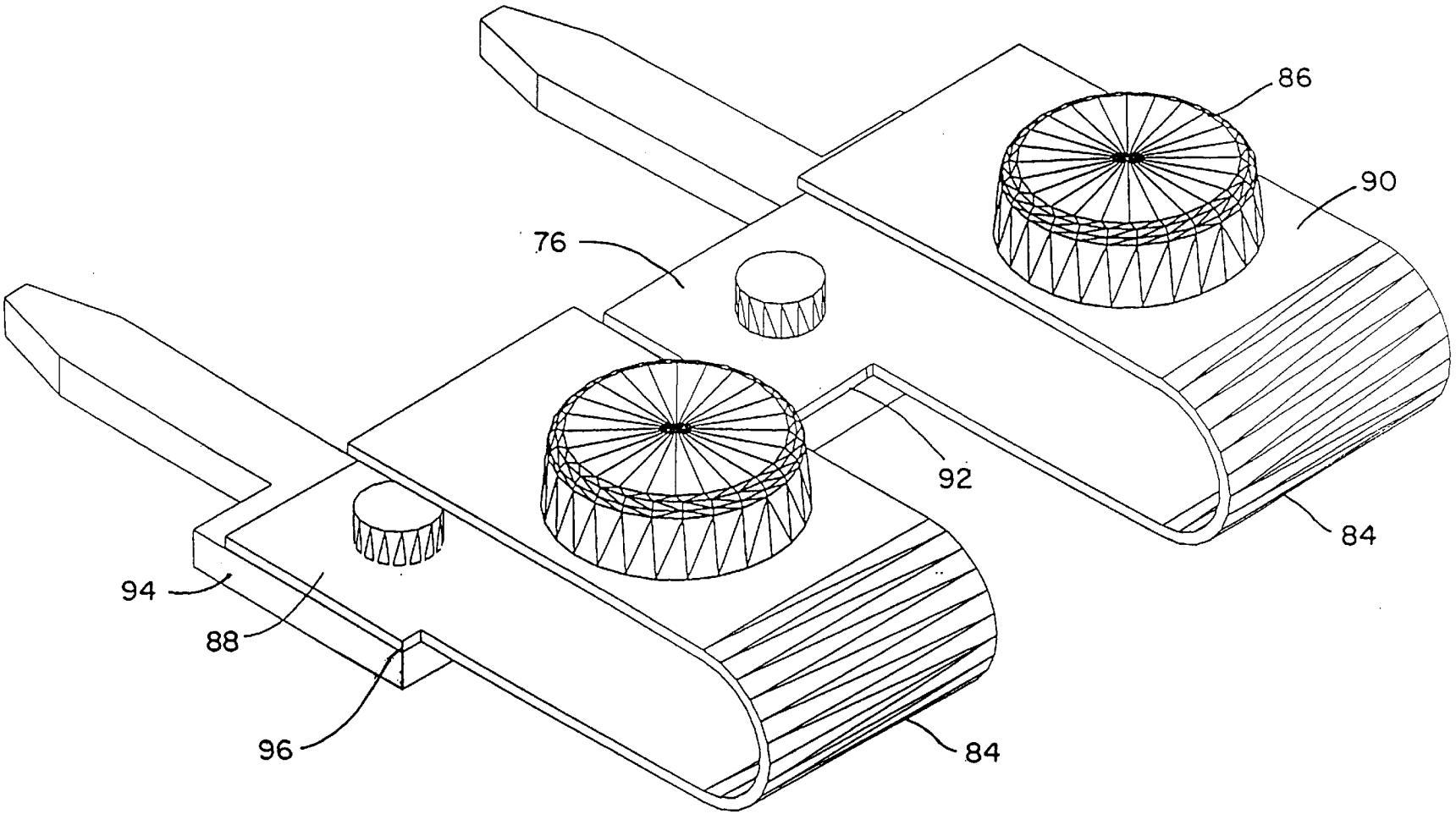
FIG. 24 is an isometric view of the normally closed contact spring assembly in the double pole embodiment.

Referring to FIGS. 20, 23, 25, and 31, each center contact spring 54 is formed straight without any pre bending. Each center contact spring 54 has a first contact rivet 64. The first contact rivet 64 extends through the center contact spring 54 and has a first contact surface 65 on one side of the center contact spring 54 and a second contact surface 67 on the other side of the center contact spring 54. The first contact rivet 64 can be comprised of material such as tungsten, silver alloy oxide, silver cadmium oxide and silver tin oxide among others. The center contact spring 54 also is stabilized and supported to the area of the center contact spring 54 where the second actuator end 48 engages the center contact spring 54. A first slot 69 can be cut through the center contact spring 54 in order to reduce the cross section of the spring, allowing lower electrical power consumption of a relay coil 18. Excellent results are also obtained without providing a slot 69 as shown in FIG. 24.

Referring to FIGS. 2, 20, 21, and 31, a normally open spring 70 is positioned relatively parallel to a center contact spring 54. The normally open spring 70 is curl shaped to be sized and fitted the normally open contact spring assembly 68 within the housing 31. Excellent results are obtained with the curl shape of the normally open spring 70 as the curl shape increased the total spring length while saving room within the housing 31. Further, the curl shape allows the normally closed contact spring assembly 84 and the normally open contact spring assembly 68 to be interchangeable. Accordingly, expensive tooling and material costs are avoided. The normally open spring 70 has a second contact rivet 72, the second contact rivet 72 positioned opposing the first contact surface 65 of the first contact rivet 64. The height of the second contact rivet 72 may differ dependent upon the contact gap requirement for the particular relay. A second slot 74 can be cut through the normally open spring 70 in order to reduce the cross section of the spring, allowing lower electrical power consumption of the relay coil 18.

Figure 22:
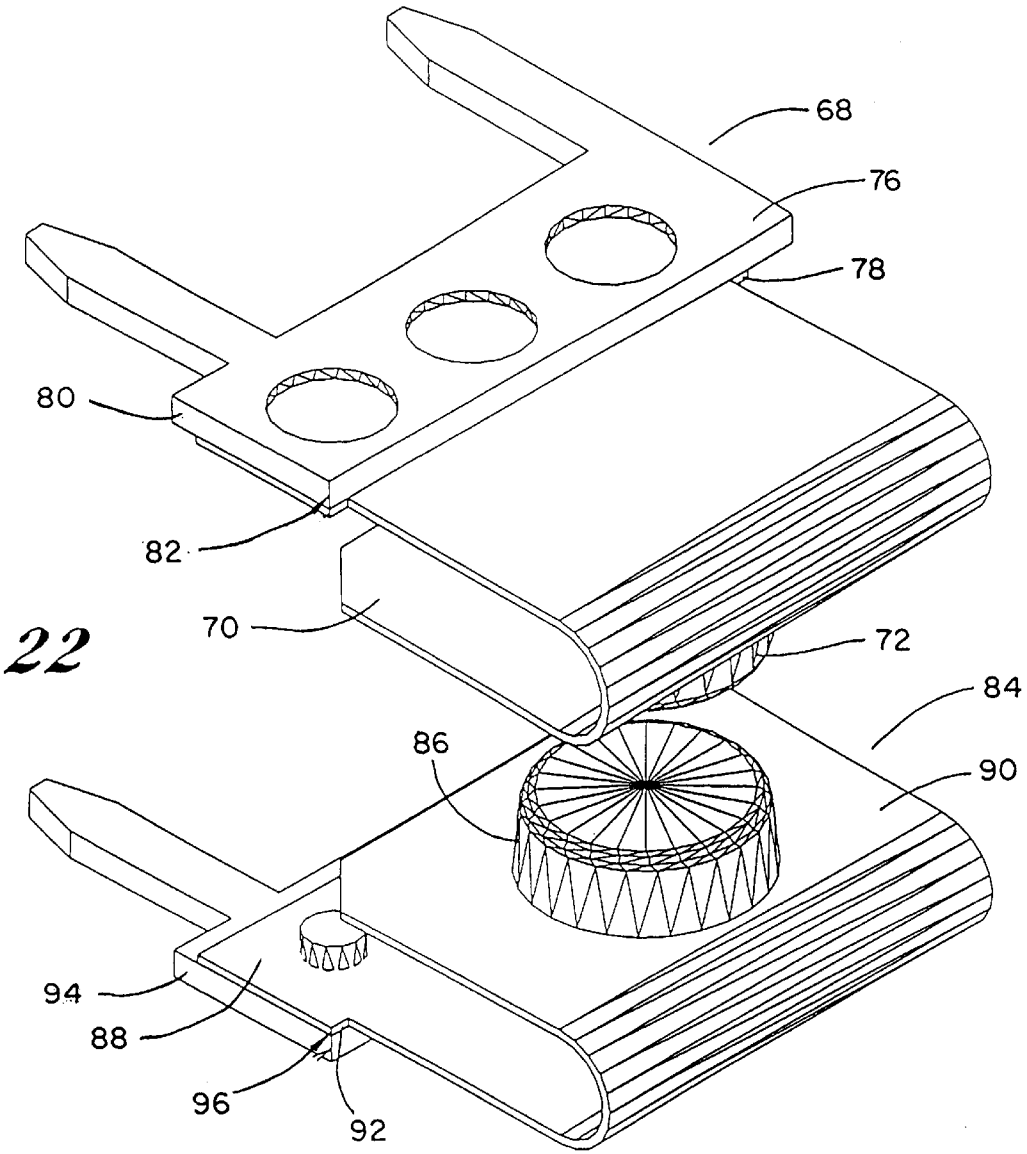
FIG. 22 is an isometric view of a normally open contact spring assembly and the normally closed contact spring assembly in the single pole embodiment wherein components are shown.

As shown in FIG. 22, the normally open spring 70 is ultrasonically metal-to-metal welded onto a normally open terminal 76 to form a normally open contact spring assembly 68. The normally open spring 70 has a second planar shaped end 78 and the normally open terminal 76 has a second metal-to-metal welded end 80 adjacently connected below the second planar shaped end 78. The second planar shaped end 78 and the second metal-to-metal welded end 80 are ultrasonically metal-to-metal welded together to form a second planar shaped weld 82 forming a normally open contact spring assembly 68. In the preferred embodiment of the invention, there can be a plurality of normally open contact spring assemblies 68 in the electromagnetic relay 10.

Figure 19:
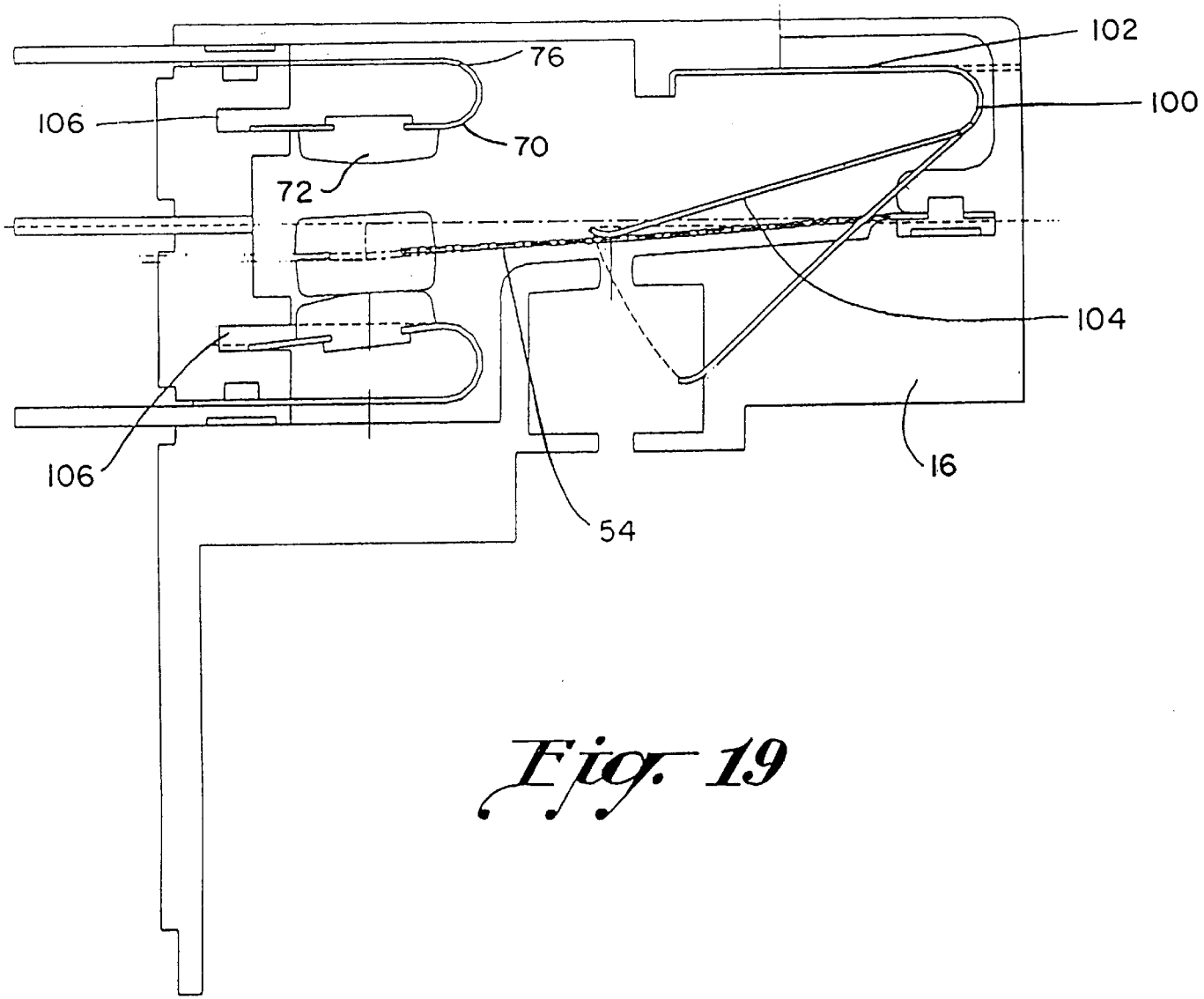
FIG. 19 is a side view of the housing with the actuator and the relay motor removed to show the pressure spring, the gaps, and center contact terminal.

A normally closed spring 90 is ultrasonically metal-to-metal welded onto a normally closed terminal 88 to form a normally closed contact spring assembly 84. The normally closed spring 90 is curl shaped to be sized and fitted the normally closed contact spring assembly 84 within the housing 31 as shown in FIGS. 19, 20 and 21. Excellent results are obtained with the curl shape of the normally closed spring 90 as the curl shape increases the total spring length while saving room within the housing 31. Further, the curl shape allows the normally closed contact spring assembly 84 and the normally open contact spring assembly 68 to be interchangeable. Accordingly, expensive tooling and material costs are avoided. The normally closed spring 90 has a third planar shaped end 92 and the normally closed terminal 88 has a third metal-to-metal welded end 94 adjacently connected below the third Planar shaped end 92. The third planar shaped end 92 and the third metal-to-metal welded end 94 are ultrasonically metal-to-metal welded together to form a third planar shaped weld 96.

A normally closed contact spring assembly 84 is comprised of a third contact rivet 86 and a normally closed terminal 88. The third contact rivet 86 is positioned relatively parallel to the second contact surface 67 of the center contact spring 54. The normally closed contact spring assembly 84 is vertically positioned with respect to a center contact spring 54 so that the third contact rivet 86 is in contact with the second contact surface 67 when the center contact spring 54 is not being acted upon by the actuator and the pressure spring 44. In the preferred embodiment of the invention, a plurality of normally closed contact spring assemblies 84 can be used in the electromagnetic relay 10.

Figure 31:
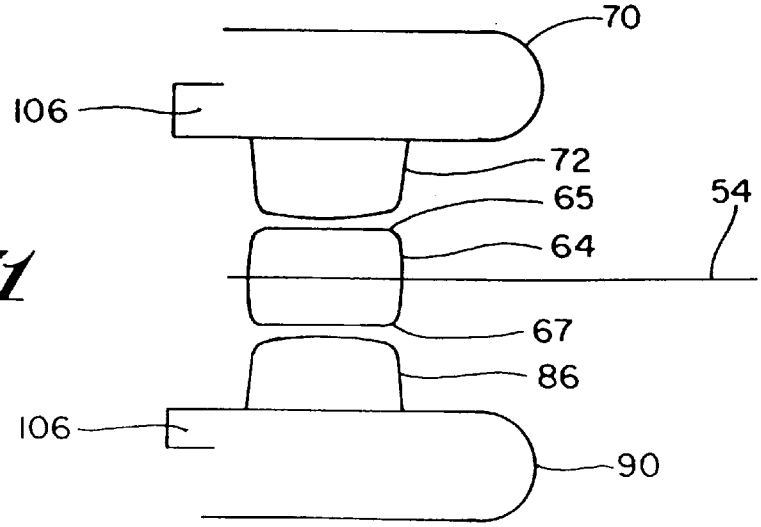
FIG. 31 is a side view of the new invention at a pre-assembly stage of a center contact spring without an action of a pressure spring, a rivet of a normally closed spring away from a rivet of the center contact spring, and a normally open spring.
Figure 32:
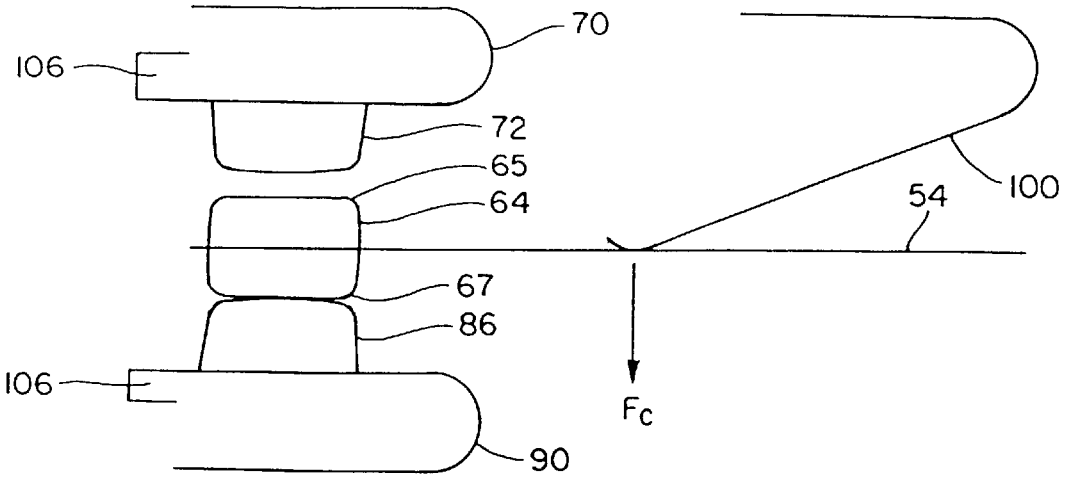
FIG. 32 is a side view of the new invention at a pre-assembly stage of a center contact spring with an action of a pressure spring, a rivet of a normally closed spring just in touch with a rivet of the center contact spring.
Figure 33:
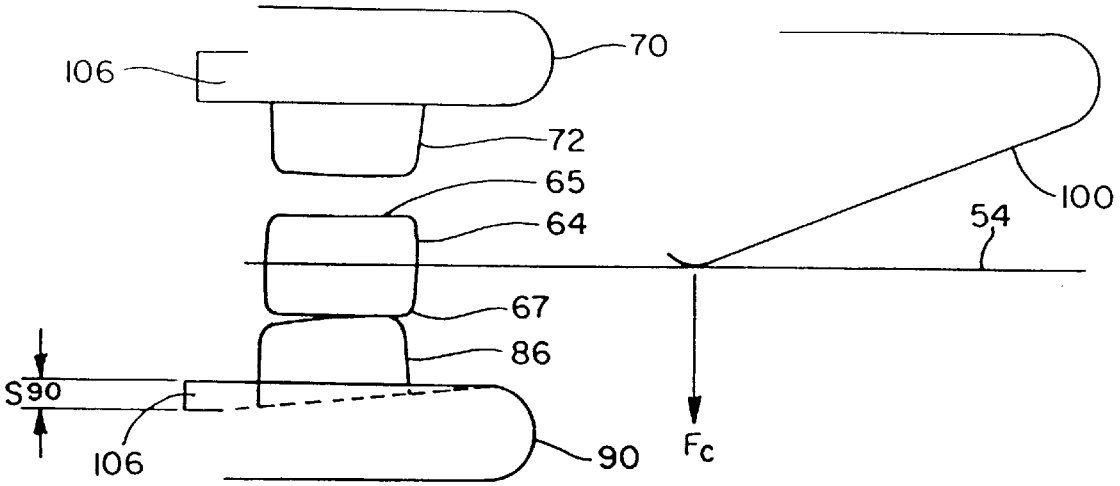
FIG. 33 is a side view of the new invention of a center contact spring with an action of a pressure spring, a rivet of a normally closed spring in touch with a rivet of the center contact spring, and the overtravel of the normally closed spring, when a relay is not in operation.
Figure 34:
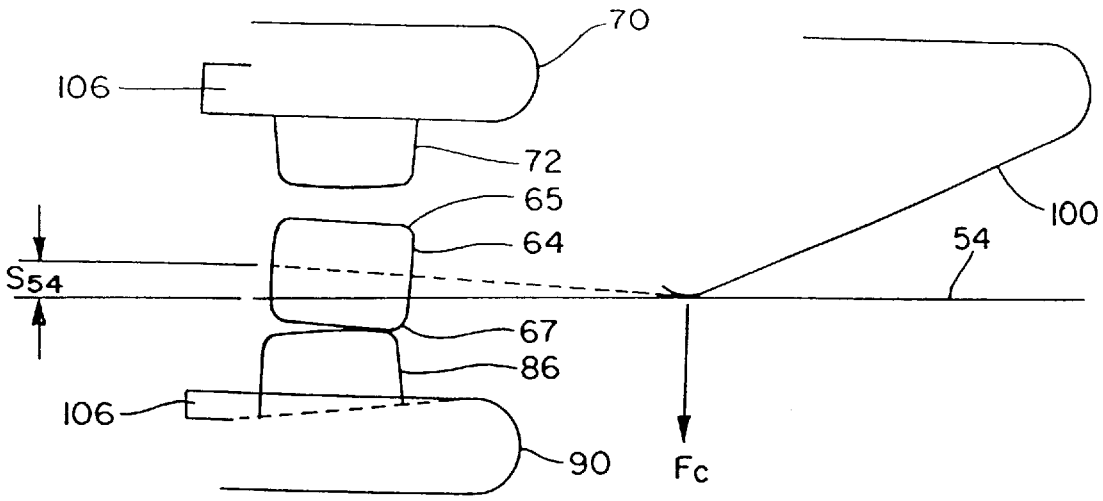
FIG. 34 is a side view of the new invention of a center contact spring with an action of a pressure spring, a rivet of a normally closed spring in touch with a rivet of the center contact spring, the overtravel of the normally closed spring, and the overtravel of the partial center contact spring, when a relay is not in operation.
Figure 35:
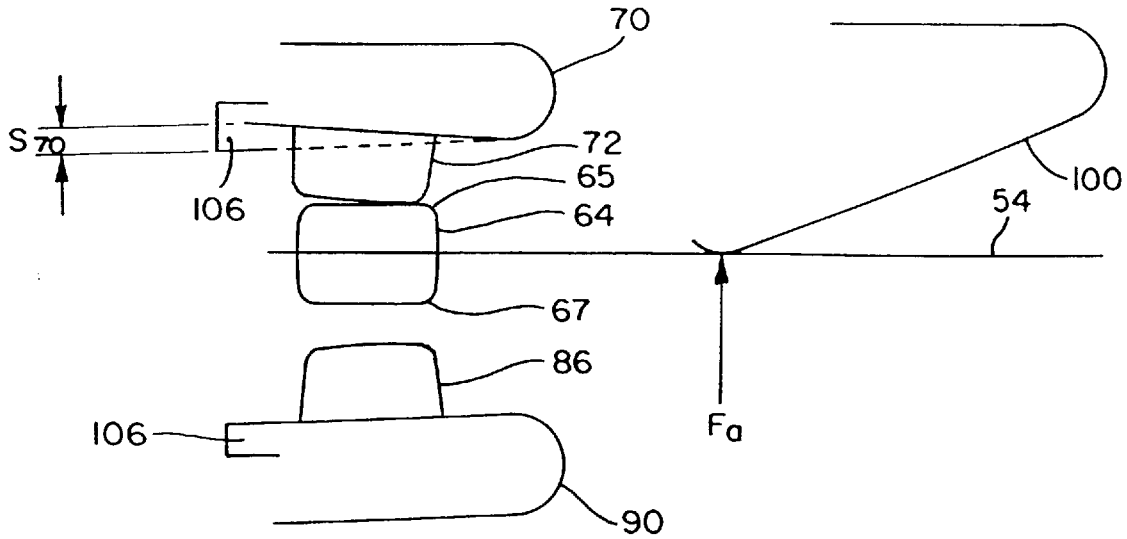
FIG. 35 is a side view of the new invention of a center contact spring with an action of a pressure spring, a rivet of a normally open spring in touch with a rivet of the center contact spring, and the overtravel of the normally open spring, when a relay is in operation.
Figure 36:
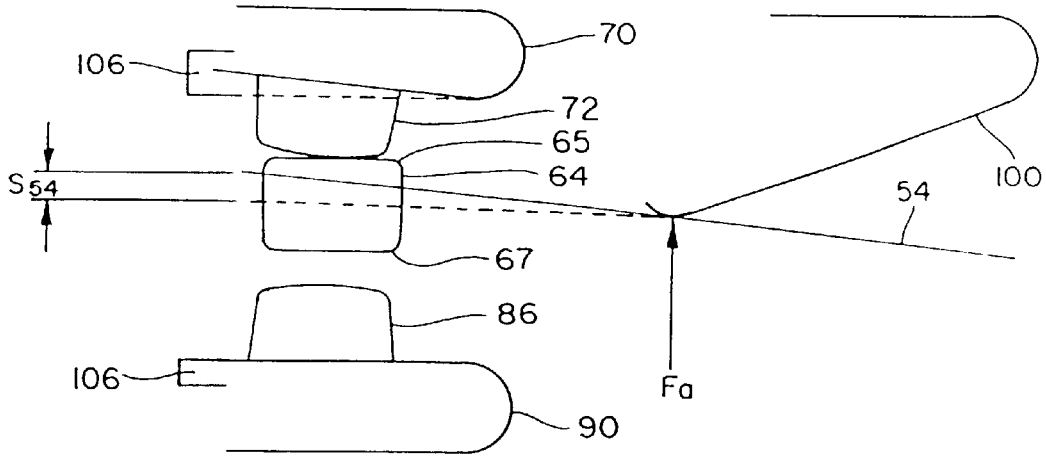
FIG. 36 is a side view of the new invention of a center contact spring with an action of a pressure spring, a rivet of a normally open spring in touch with a rivet of the center contact spring, the overtravel of the normally open spring, and the overtravel of the partial center contact spring, when a relay is in operation.

As shown in FIGS. 2, 3, 20, 21, 32, 33, 34, 35, and 36, grooves 106 are provided in the frame 16. These grooves 106 provide multiple purposes. First, the grooves 106 support the normally closed spring 90 and the normally open spring 70 while the normally closed spring 90 and the normally open spring 70 are not being acted on by the center contact spring 54 as shown in FIG. 31. Second, the groove 106 of the normally closed spring 90 limits bending of the normally closed spring 90 when the normally closed spring 90 is being acted on by the center contact spring 54 as shown in FIGS. 32, 33, and 34. Further, the groove 106 of the normally open spring 70 limits bending of the normally open spring 70 when the normally open spring 70 is being acted on by the center contact spring 54 as shown in FIGS. 35 and 36. $s_{70}$ shown in FIG. 30 represents a partial spring deflection of the normally open spring 70. $S_{54}$ shown in FIG. 31 represents a partial spring deflection of the center contact spring 54. $F_a$ shown in both FIGS. 30 and 31 represents a force from an actuator when the relay is in operation. Thus, the grooves 106 are sized and shaped to confine to the desired contact gap and overtravel. In the preferred embodiment, the groove 106 for one end of the normally open spring 70 is typically larger than the groove 106 for one end of the normally closed spring 90. However, excellent results are obtained with a plurality of sizes for the grooves 106.

Referring to FIGS. 32, 33, and 34, as the center contact spring 54 is not pre bent, a force $F_c$ is needed to pressure the rivet 64 of the center contact spring 54 on the rivet 86 of the normally closed spring 90 when the center contact spring 54 is not being acted upon by the actuator 44. The pressure spring 100 provides this pressure force $F_c$. Both $s_{90}$ and $s_{54}$ represent partial spring deflection of the center contact spring 54. Excellent results are obtained when the pressure spring 100 is utilized as it reduces the deflection of the center contact spring 54 to a third of conventional relays. In the preferred embodiment, excellent results are obtained when the pressure force applied by the pressure spring 100 is 20 cN measured at the center of the contact areas. Thus, without the pre bending or deflection the center contact spring 54 sustains a longer life. This reduced deflection allows the spring to be thicker which in turn increases the spring's ability to carry increased amperage. The pressure spring 100 is preferably comprised of steel as the pressure spring 100 is not in any current path; and, thus, it does not have to be electrically conductive. Further, steel has a much better spring property than any copper alloy or even beryllium copper.

The pressure spring assemble 100 has a retaining end 102 and a pressure end 104. The retaining end 102 is positioned opposite of the normally closed contact spring assembly 84 by locating in a slot molded into the housing 31 as shown in FIGS. 19, 20, and 21. Opposite of the retaining end 102 is the pressure end 104. The pressure end 104 applies pressure to the center contact spring 54 at a point perpendicularly above the actuator 44. Thus, the pressure end 104 applies pressure at an angle between the center contact spring 54 and the normally closed spring 90.

Referring to FIG. 1, in the preferred embodiment, the electromagnetic relay device 10 is housed in a housing comprised of a cover 30 and a base 25. The cover 30 and the base 25 is made from a thermoplastic material, and a sealing compound is used to seal the cover 30 to the base 25. The cover 30 and the base 25 not only serves to protectively encase the electromagnetic relay 10 but it also provides positional and structural support to the components which comprise the electromagnetic relay 10.

Referring to FIGS. 1 and 21, when energized, the terminals 20 of the relay coil 18 accept a current that runs throughout the relay coil 18 causing a magnetic field that magnetizes the core 22. The magnetic force draws the first armature end 36 into contact with the core end 24 causing the actuator 44 to apply a force on the center contact spring 54 which moves the rivet 64 of the center contact spring 54, breaking contact with the rivet of the normally closed spring 84 and establishing contact with the rivet of the normally open spring 70.

Referring to FIG. 20, when the relay coil 18 is not energized the armature 34 is disengaged from the core end 24 and no force is applied to the center contact spring 54 by the actuator 44 causing the center contact spring 54 to return to its original position, the center contact spring 54 reestablishing contact with third contact rivet 86 and the normally closed spring 90 as well as overtravel.

The present invention has advantages that permit the device to successfully transfer higher currents while maintaining a relatively small overall package size. First, the center contact spring 54, the normally closed spring 90 and the normally open spring 70 are made from a copper alloy and the center contact terminal 56, the normally closed terminal 88 and the normally open terminal 76 are made from pure copper. Prior art electromagnetic relays typically use bronze and brass materials for the springs and terminals. Copper alloy and pure copper are more conductive materials so they are able to handle greater current flow. In the preferred embodiment, the copper alloy is composed of 0.3% Cr, 0.1%Ti, 0.02%Si, and the balance being Cu. This composition has a conductivity which is roughly 75% of pure copper. However, a copper alloy having a conductivity which is at least 50% of the conductivity of pure copper, or greater, may also be used.

Secondly, in the prior art, springs and terminals are joined together by spot welding (otherwise called resistance welding). The contact area through which the electric current flows between the spring and terminal is limited to the area of the spot weld joint. Resistance welding is particularly difficult to do when the two materials to be joined are made of highly conductive material such as copper. Consequently, less conductive materials like brass and bronze were typically used in the construction of prior art relays in order to make the spot welding process easier and less costly.

Ultrasonic welding techniques involve the use of high frequency vibrations and a compressing force to anneal the copper materials together. The use of ultrasonic welding techniques allows the contact area between springs and terminals to be expanded to the entire surface area where the springs and the terminals meet. In the preferred embodiment, the surface area between the center contact springs 54 and the center contact terminals 56 and also between the normally open springs 70 and the normally open terminals 76 is expanded by having a planar shaped end on both the center contact springs 54 and the normally open springs 70. By using ultrasonic welding, the expanded surface areas between the center contact springs 54 and the center contact terminals 56 and also between the normally open springs 70 and the normally open terminals 76 results in greater contact areas. The greater the contact area between a spring and a terminal, the larger the current that can be transferred between a spring and a terminal.

Therefore, by using materials with high conductivity properties and increasing the contact area between the spring and the terminal, the present invention can handle higher currents while maintaining a relatively small overall package size. In the preferred embodiment, the electromagnetic relay 10 is PC board mountable with a depth of 29 mm, a height of 25.4 mm, and a width of 12.7 mm. As shown in FIGS. 7–18, the present invention contains multiple embodiments covering multiple poles and assemblies. As such, the present invention can be single pole, double pole and multi pole. As such, the present invention can have a plurality of center contact assemblies 52, normally open contact spring assemblies 68, normally closed contact spring assemblies 84 and pressure springs 100 covering one change over, two change over, and one double make-double break variations known in the industry. The present invention in the single pole embodiment can transfer approximately 25 amps while the double pole embodiment can transfer approximately 12.5 amps.

Figure 15:
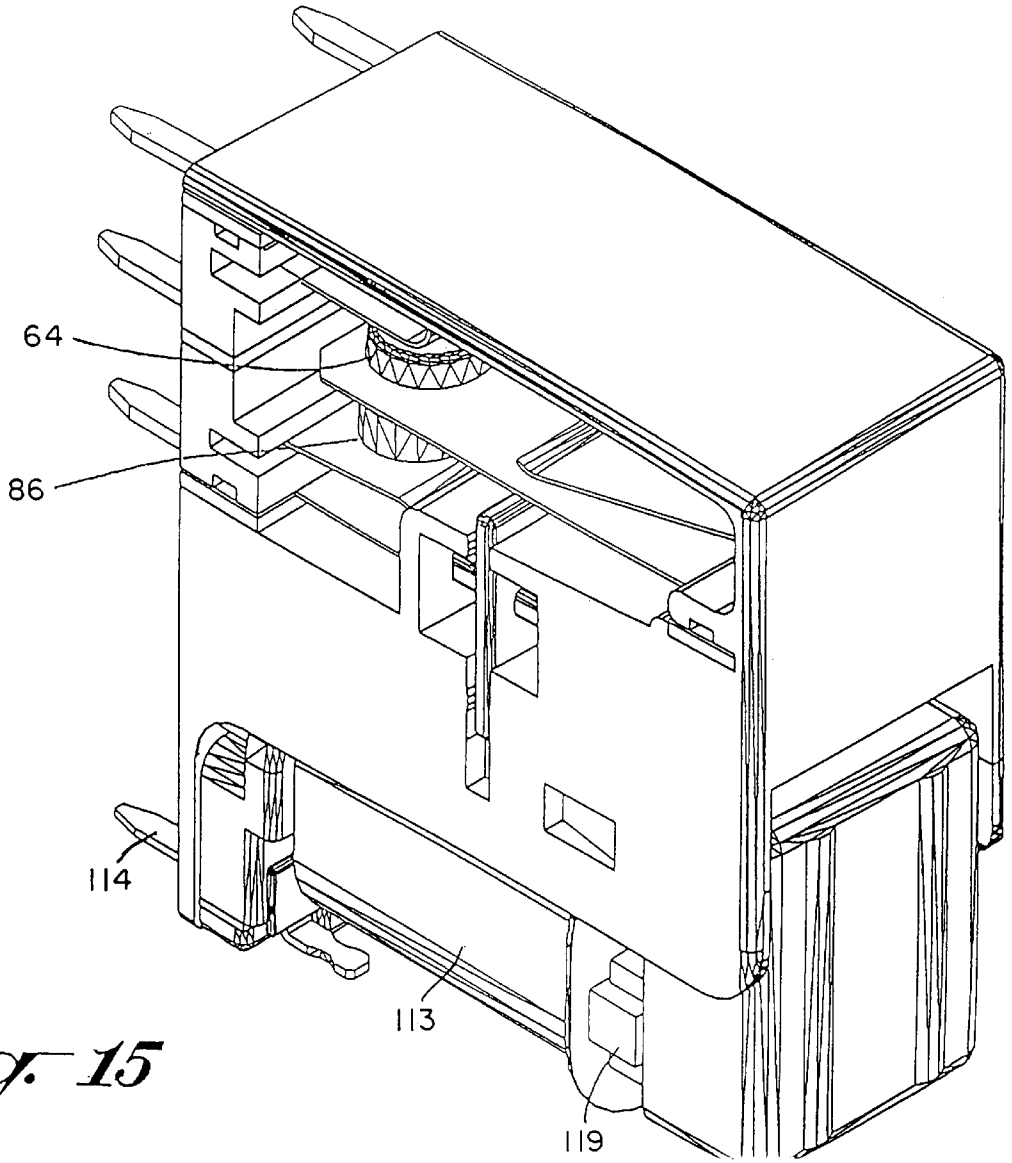
FIG. 15 is an isometric view of one change over (SPDT) embodiment with a latching motor.
Figure 16:
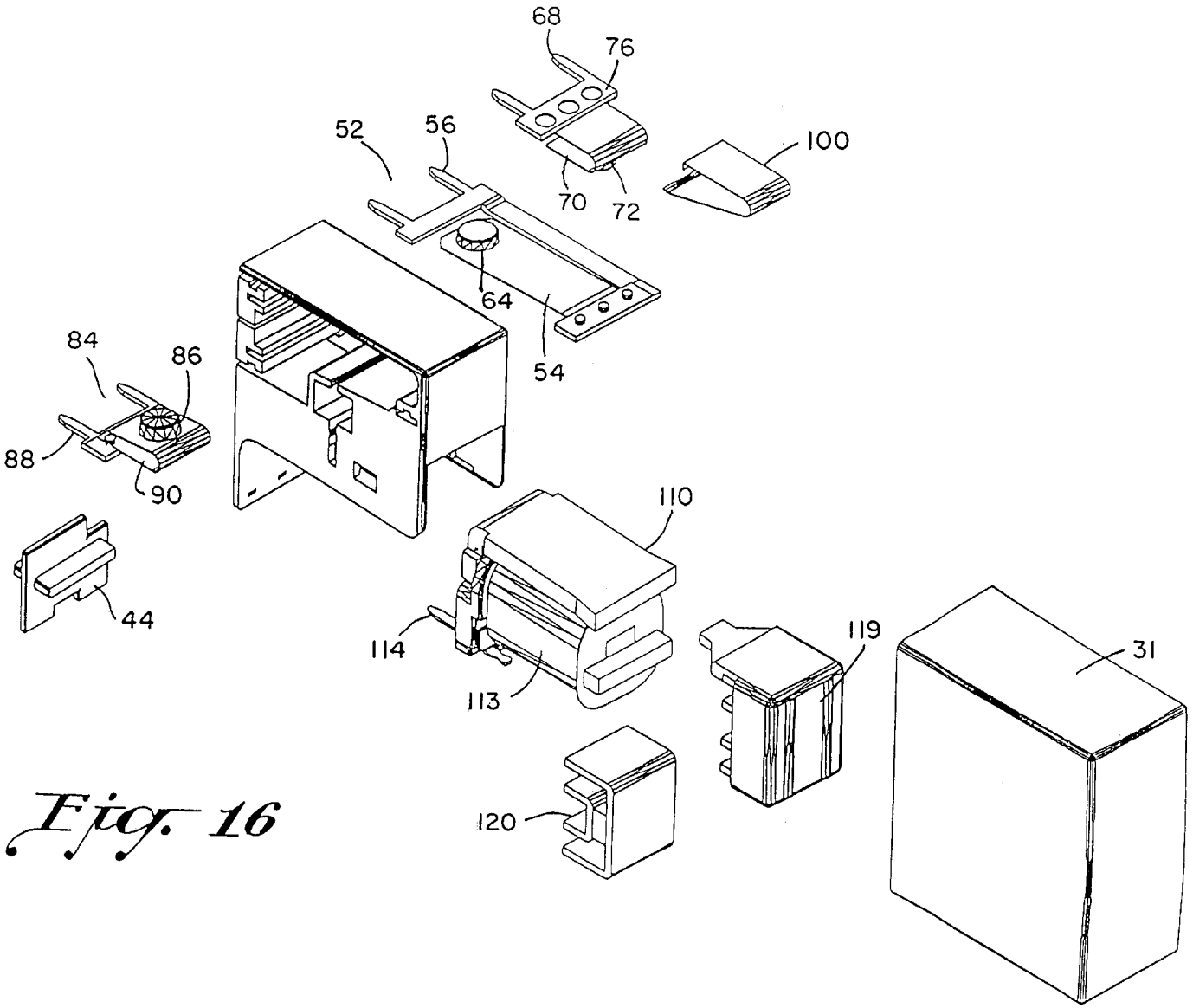
FIG. 16 is an exploded view of FIG. 15.
Figure 17:
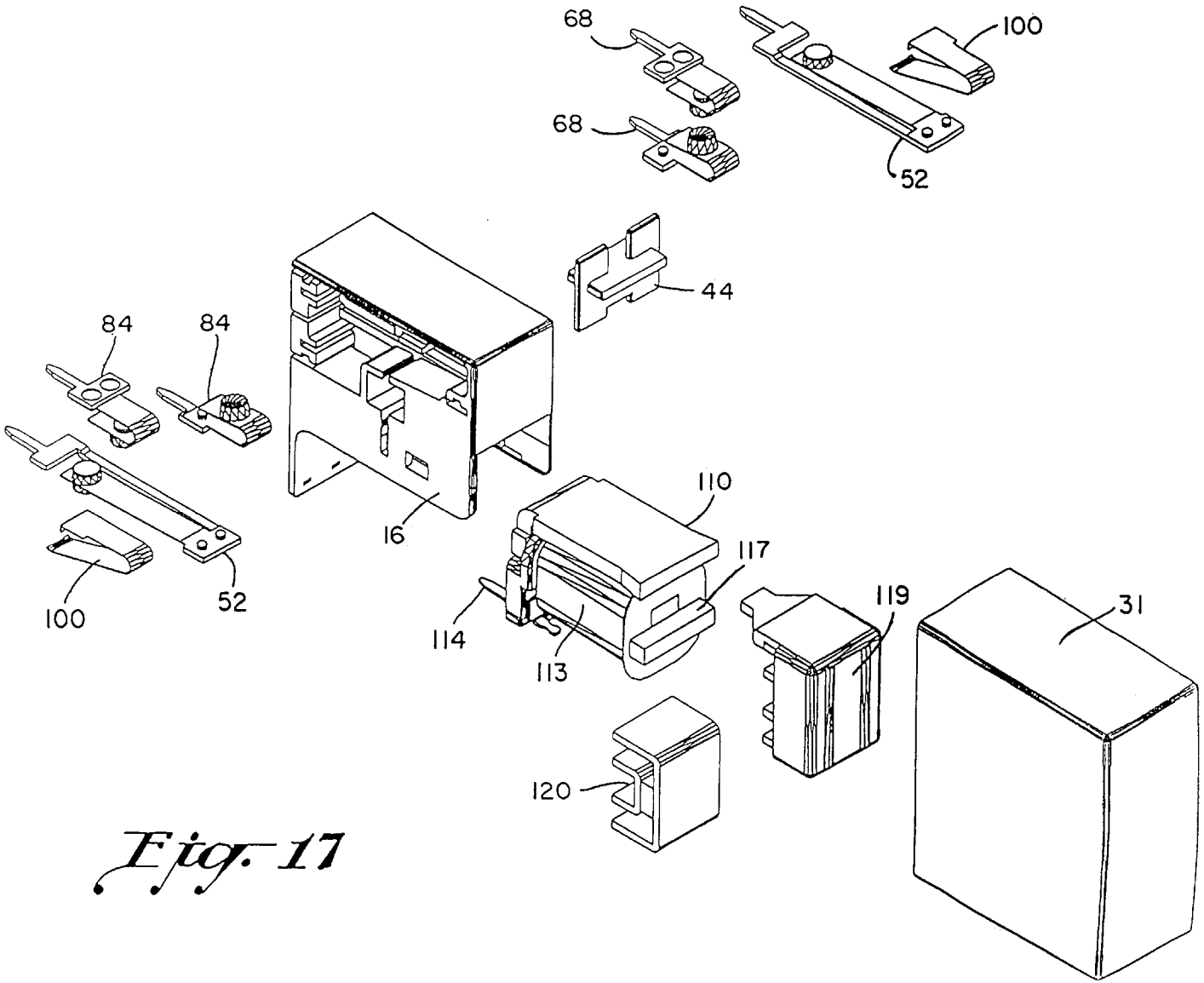
FIG. 17 is an exploded view of the two change over (DPDT) embodiment with a latching motor.
Figure 18:
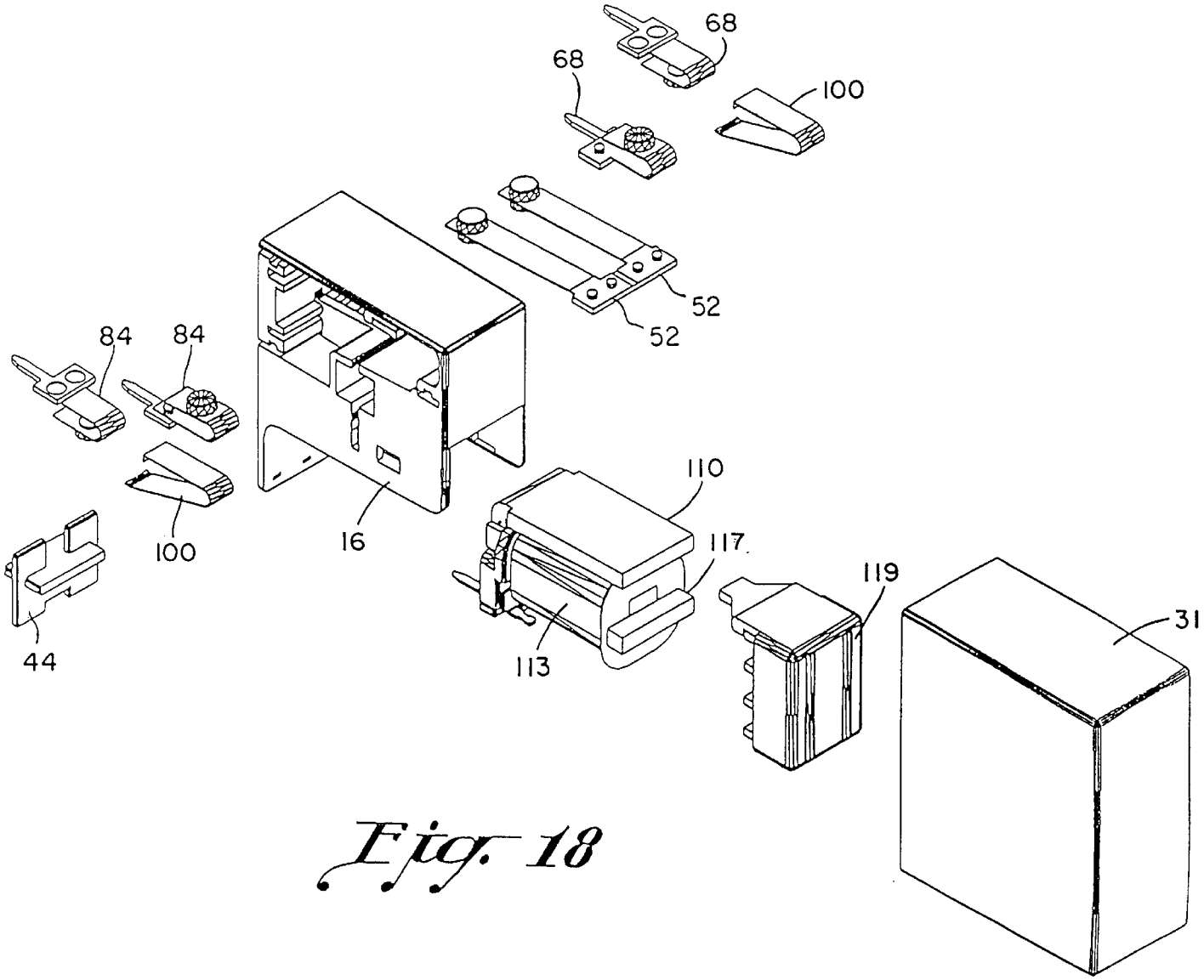
FIG. 18 is an exploded view of the double break-double make (DB-DM) embodiment with a latching motor.
Figure 37:
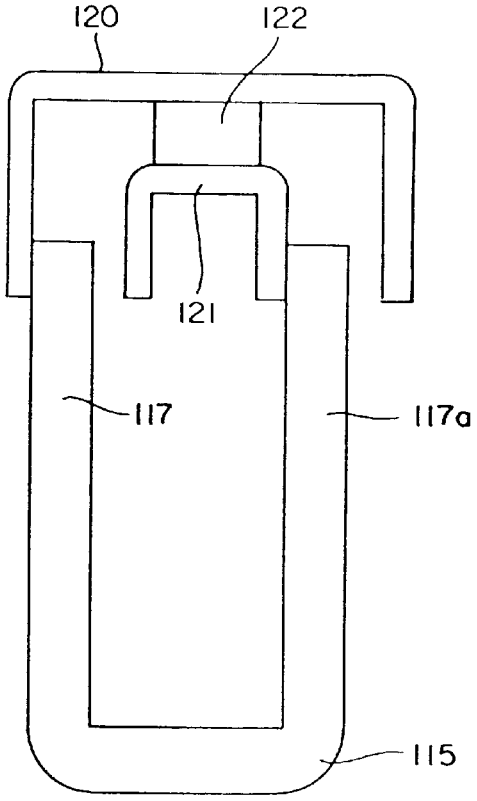
FIG. 37 is a side view of the orientation of the pole piece with respect to the ferromagnetic frame in a first position in a preferred embodiment.
Figure 38:
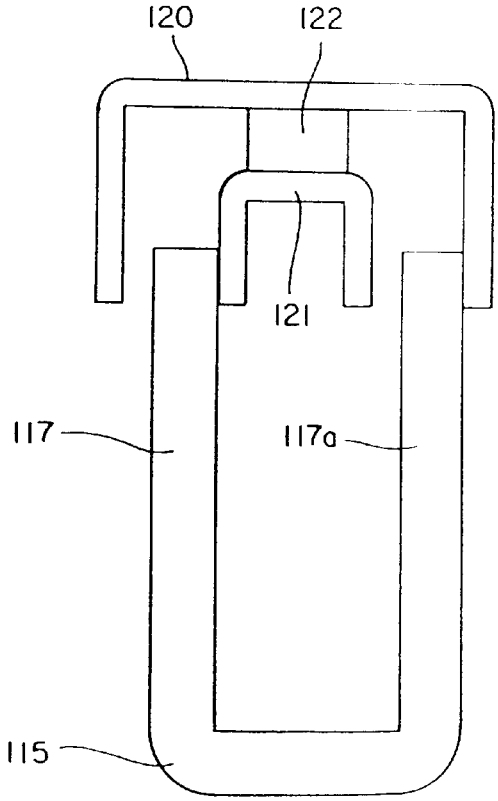
FIG. 38 is a side view of the orientation of the pole piece with respect to the ferromagnetic frame in a second position in a preferred embodiment.

Referring to FIGS. 15 and 16, in an alternative embodiment, the present invention is driven by the movement of pole pieces in response to the polarity of a current running through an excitation coil 113. A linear movement occurs when the polarity of the current running through the excitation coil 113 causes the magnetic flux in the ferromagnetic system to induce first 120 and second pole pieces 121 to magnetically couple to the contact sections opposite the contact section that they were previously magnetically coupled to, which is shown in FIGS. 37 and 38.

The resulting linear movement of the pole pieces 120, 121 is translated into a linear movement of the actuator assembly 44. This linear movement of the actuator assembly 44 either drives the center contact spring 54 into contact with a pair of contact areas positioned on opposite sides of the center contact spring 54, or drives the center contact spring into breaking contact with the contact areas.

Referring to FIGS. 16, 17, 37 and 38, there are shown two positions, with respect to the ferromagnetic frame 115, in which the first 120 and second pole pieces 121 of the preferred embodiment linearly reciprocate between. This linear movement of the pole pieces 120, 121 drive the movement of the actuator assembly 44. In the alternative preferred embodiment of the present invention, a generally U shaped ferromagnetic frame 115 has a plurality of core sections 116 disposed in and extending through the axially extending cavity in the elongated coil bobbin and a first contact section 117 and a second contact section 117*a* extending generally perpendicularly to the core sections 116 and rising above the motor assembly. The ferromagnetic frame 115 can be a single piece or broken into an assembly of several different sections so long as continuity is maintained through all the pieces upon assembly.

Hence, this invention provides an electromagnetic relay that is small in size yet capable of handling high current switching and also with 1.5 mm resp. 3.0 mm contact gap.

This invention also provides an electromagnetic relay with a contact assembly comprised of more conductive material than brass and bronze and having a greater contact surface between the springs and the terminals.

This invention also provides an electromagnetic relay without a pre bent center contact spring.

This invention also provides an electromagnetic relay with large contact gap.

This invention also provides an electromagnetic relay with higher switching and operating current.

This invention also provides a small latching magnetic relay with a motor that generates a linear movement to accommodate contact assemblies, which require only a linear movement while utilizing a pressure spring for the center contact spring.

This invention also provides a latching magnetic relay with a contact assembly comprised of more conductive material than brass and bronze and having a greater contact surface between the spring and terminal.

The foregoing descriptions of the preferred embodiments of the invention have been presented for purposes of illustration and description, and are not intended to be exhaustive or to limit the invention to the precise forms disclosed. The descriptions were selected to best explain the principles of the invention and their practical application to enable others skilled in the art to best utilize the invention in various embodiments and various modifications as are suited to be particular use contemplated. It is not intended that the novel device be limited thereby. The preferred embodiment may be susceptible to modifications and variations that are within the scope and fair meaning of the accompanying claims and drawings.

I claim:

1. An electromagnetic relay device comprising:

a relay motor, the relay motor having a relay coil, the relay coil having a magnetic core disposed therein, the magnetic core having a magnetic core end extending from the relay motor;

an armature, the armature having a first armature end and a second armature end, the first armature end magnetically coupled to the magnetic core end;

an actuator, the actuator having a first actuator end and a second actuator end, the first actuator end operatively coupled to the second armature end;

a center contact spring assembly, the center contact spring assembly comprising a center contact spring, the center contact spring being formed straight without pre bending, the center contact spring made of a copper alloy comprising a chemical composition of 0.3% Cr, 0.1%Ti, 0.02%Si, and the balance Cu, and a center contact terminal made of pure copper, the center contact spring having a first contact rivet, permanently attached to the center contact spring with a first contact surface and a second contact surface, and a first planar shaped end, the center contact terminal having a second planar shaped end, the first planar shaped end of the center contact spring and the second planar shaped end of the center contact terminal being ultrasonically metal-to-metal welded to each other forming a planar shaped weld spanning the area between the first planar shaped end of the center contact spring and the second planar shaped end of the center contact terminal, the center contact spring operatively coupled to the second actuator;

a normally open contact spring assembly, the normally open contact spring assembly being curl shaped to be sized and fitted within the electromagnetic relay, the normally open contact spring assembly having a normally open spring made of a copper alloy comprising a chemical composition of 0.3% Cr, 0.%Ti, 0.02%Si, and the balance Cu and a normally open terminal made of pure copper, the normally open spring having a second contact rivet, permanently attached to the normally open spring, with a third contact surface, and a third planar shaped end, the normally open terminal having a fourth planar shaped end, the third planar shaped end of the normally open spring and the fourth planar shaped end of the normally open terminal being ultrasonically metal-to-metal welded to each other forming a planar shaped weld spanning the area between the third planar shaped end of the normally open spring and the fourth planar shaped end of the normally open terminal allowing for greater current flow between the normally open spring and the normally open terminal, the normally open spring positioned relatively parallel to the center contact spring with the second contact rivet positioned opposite the first contact surface of the first contact rivet, the normally open spring vertically positioned with respect to the center contact spring assembly so that the first contact surface of the first contact rivet touches the second contact rivet when the center contact spring is acted upon by the actuator;

a normally closed contact spring assembly, the normally closed contact spring assembly being curl shaped to be sized and fitted within the electromagnetic relay, the normally closed contact spring assembly having a normally closed spring made of a copper alloy comprising a chemical composition of 0.3% Cr, 0.1%Ti, 0.02%Si, and the balance Cu and a normally closed terminal made of pure copper, the normally closed spring having a third contact rivet, permanently attached to the normally closed spring with a fourth contact surface, and a fifth planar shaped end, the normally closed terminal having a sixth planar shaped end, the fifth planar shaped end of the normally closed spring and the sixth planar shaped end of the normally closed terminal being ultrasonically metal-to-metal welded to each other forming a planar shaped weld spanning the area between the fifth planar shaped end of the normally closed spring and the sixth planar shaped end of the normally closed terminal allowing for greater current flow between the normally closed spring and the normally closed terminal, the normally closed contact spring assembly is vertically positioned with respect to the center contact spring so that the third contact rivet is in contact with the second contact surface of the first contact rivet when the center contact spring is not being acted upon by the actuator;

a pressure spring, the pressure spring being made of steel, the pressure spring having a retaining end, the retaining end positioned opposite of the normally open contact spring assembly for positioning the pressure spring, the pressure spring further having a pressure end, the pressure end contacting the center contact spring perpendicularly above the actuator, the pressure end applying pressure to the center contact spring for pressuring the second contact surface of the first contact rivet into contact with the fourth contact surface of the third contact rivet without pre bending the center contact spring when the center contact spring is not being acted upon by the actuator; and a housing, the housing having the relay motor, the armature, the actuator, the center contact spring assembly, the normally open contact spring assembly, the normally closed contact spring assembly, and the pressure spring disposed therein.

2. The electromagnetic relay device defined in claim 1 wherein the center contact spring of the center contact spring assembly has a first slot therethrough, and the normally open spring of the normally open contact spring assembly has a second slot therethrough, the first slot and the second slot reducing the cross section of the center contact spring and the normally open spring, reducing the bending force of both the center contact spring and the normally open spring, and reducing the electrical power consumption of the relay coil.

3. The electromagnetic relay device defined in claim 1 wherein the electromagnetic relay device has a plurality of center contact spring assemblies, normally open contact spring assemblies, normally closed contact spring assemblies and pressure springs.

4. The electromagnetic relay device defined in claim 1 wherein the relay motor can either be an all-or-nothing DC operated relay motor, or an all-or-nothing AC operated relay motor, or a magnetic latching linear operating relay motor.

5. An electromagnetic relay device comprising:

a relay motor, the relay motor having a relay coil;

an armature, the armature having a first armature end and a second armature end, the first armature end coupled to the relay motor;

an actuator, the actuator having a first actuator end and a second actuator end, the first actuator end operatively coupled to the second armature end;

a center contact spring assembly, the center contact spring assembly having a center contact spring, the center contact spring being formed straight without pre bending, the center contact spring made of a copper alloy with a conductivity which is 50% or greater of the conductivity of pure copper and a center contact terminal made of pure copper, the center contact spring having a first contact rivet, permanently attached to the center contact spring with a first contact surface and a second contact surface, and a first planar shaped end, the center contact terminal having a second planar shaped end, the first planar shaped end of the center contact spring and the second planar shaped end of the center contact terminal being ultrasonically metal-to-metal welded to each other forming a planar shaped weld spanning the area between the first planar shaped end of the center contact spring and the second planar shaped end of the center contact terminal, the center contact spring operatively coupled to the second actuator allowing for greater current flow between the center contact spring and the center contact terminal, the center contact spring operatively coupled to the second actuator end; and a normally open contact spring assembly, the normally open contact spring assembly being curl shaped, the normally open contact spring assembly having a normally open spring made of a copper alloy with a conductivity which is 50% or greater of the conductivity of pure copper and a normally open terminal made of pure copper, the normally open spring having a second contact rivet, permanently attached to the normally open spring, with a third contact surface, and a third planar shaped end, the normally open terminal having a fourth planar shaped end, the third planar shaped end of the normally open spring and the fourth planar shaped end of the normally open terminal being ultrasonically metal-to-metal welded to each other forming a planar shaped weld spanning the area between the third planar shaped end of the normally open spring and the fourth planar shaped end of the normally open terminal allowing for greater current flow between the normally open spring and the normally open terminal, the normally open spring positioned relatively parallel to the center contact spring, the normally open spring vertically positioned with respect to the center contact spring assembly so that the first contact surface of the first contact rivet touches the second rivet when the center contact spring is acted upon by the actuator; and a pressure spring, the pressure spring being made of steel, the pressure spring having a retaining end, the retaining end positioned opposite of the normally open contact spring assembly for positioning the pressure spring, the pressure spring further having a pressure end, the pressure end contacting the center contact spring perpendicularly above the actuator, pressing the center contact spring in contact with the second actuator end.

6. The electromagnetic relay device defined in claim 5 wherein the center contact spring having a first contact rivet, permanently attached to the center contact spring with a first contact surface and a second contact surface, and a first planar shaped end, the center contact terminal having a second planar shaped end, the first planar shaped end of the center contact spring and the second planar shaped end of the center contact terminal being ultrasonically metal-to-metal welded to each other forming a planar shaped weld spanning the area between the first planar shaped end of the center contact spring and the second planar shaped end of the center contact terminal allowing for greater current flow between the center contact spring and the center contact terminal.

7. The electromagnetic relay device defined in claim 6 wherein the normally open spring having a second contact rivet, permanently attached to the normally open spring, with a third contact surface, and a third planar shaped end, the normally open terminal having a fourth planar shaped end, the third planar shaped end of the normally open spring and the fourth planar shaped end of the normally open terminal being ultrasonically metal-to-metal welded to each other forming a planar shaped weld spanning the area between the third planar shaped end of the normally open spring and the fourth planar shaped end of the normally open terminal allowing for greater current flow between the normally open spring and the normally open terminal.

8. The electromagnetic relay device in claim 7 wherein the center contact spring and the normally open spring is made from a copper alloy having a chemical composition of 0.3% Cr, 0.1%Ti, 0.02%Si, and the balance Cu.

9. The electromagnetic relay device defined in claim 8 wherein the center contact spring of the center contact spring assembly has a first slot therethrough, and the normally open spring of the normally open contact spring assembly has a second slot therethrough, the first slot and the second slot reducing the cross section of the center contact spring and the normally open spring, reducing the bending force of both the center contact spring and the normally open spring, and reducing the electrical power consumption of the relay coil.

10. The electromagnetic relay device defined in claim 9 further comprising a normally closed contact spring assembly, the normally closed contact spring assembly being curl shaped, the normally closed contact spring assembly having a normally closed spring made of a copper alloy comprising a chemical composition of 0.3% Cr, 0.1%Ti, 0.02%Si, and the balance Cu and a normally closed terminal made of pure copper, the normally closed spring having a third contact rivet, permanently attached to the normally closed spring with a fourth contact surface, and a fifth planar shaped end, the normally closed terminal having a sixth planar shaped end, the fifth planar shaped end of the normally closed spring and the sixth planar shaped end of the normally closed terminal being ultrasonically metal-to-metal welded to each other forming a planar shaped weld spanning the area between the fifth planar shaped end of the normally closed spring and the sixth planar shaped end of the normally closed terminal allowing for greater current flow between the normally closed spring and the normally closed terminal, the normally closed contact spring assembly is vertically positioned with respect to the center contact spring so that the third contact rivet is in contact with the second contact surface of the first contact rivet when the center contact spring is not being acted upon by the actuator and the pressure spring.

11. An electromagnetic relay device comprising:

a relay motor, the relay motor having a relay coil;

an armature, the armature having a first armature end and a second armature end, the first armature end coupled to the relay motor;

an actuator, the actuator having a first actuator end and a second actuator end, the first actuator end operatively coupled to the second armature end;

a center contact spring assembly, the center contact spring assembly having a center contact spring, the center contact spring being formed straight without pre bending, the center contact spring made of a copper alloy with a conductivity which is 50% of the conductivity of pure copper or greater and a center contact terminal made of pure copper, the center contact spring and the center contact terminal each having end portions which are ultrasonically metal-to-metal welded to each other forming a first weld spanning the area between the end portions allowing for greater current flow between the center contact spring and the center contact terminal, the center contact spring assembly operatively coupled to the second actuator end;

a pressure spring, the pressure spring being made of steel, the pressure spring having a retaining end, the retaining end positioned opposite of a normally open contact spring assembly for positioning the pressure spring, the pressure spring further having a pressure end, the pressure end contacting the center contact spring perpendicularly above the actuator, the pressure end applying pressure to the center contact spring for pressuring the second contact surface of the first contact rivet into contact with a fourth contact surface of a third contact rivet of a normally closed spring without pre bending the center contact spring when the center contact spring is not being acted upon by the actuator; and a housing, the housing having the relay motor, the armature, the actuator, the center contact spring assembly, and the pressure spring disposed therein.

12. The electromagnetic relay device defined in claim 11 wherein the relay motor can either be an all-or-nothing DC operated relay motor, or an all-or-nothing AC operated relay motor, or a magnetic latching linear operating relay motor.

13. The electromagnetic relay device defined in claim 11 wherein the center contact spring has a first contact rivet permanently attached to the center contact spring with a first contact surface and a second contact surface.

14. The electromagnetic relay device in claim 11 wherein the center contact spring is made from a copper alloy comprising a chemical composition of 0.3% Cr, 0.1%Ti, 0.02%Si, and the balance Cu.

15. The electromagnetic relay device defined in claim 11 wherein the center contact spring having a first contact rivet, permanently attached to the center contact spring with a first contact surface and a second contact surface, and a first planar shaped end, the center contact terminal having a second planar shaped end, the first planar shaped end of the center contact spring and the second planar shaped end of the center contact terminal being ultrasonically metal-to-metal welded to each other forming a planar shaped weld spanning the area between the first planar shaped end of the center contact spring and the second planar shaped end of the center contact terminal allowing for greater current flow between the center contact spring and the center contact terminal.

16. The electromagnetic relay device in claim 11 further comprising a normally open contact spring assembly, the normally open contact spring assembly being curl shaped, the normally open contact spring assembly having a normally open spring made of a copper alloy with a conductivity which is 50% of the conductivity of pure copper or greater and a normally open terminal made of pure copper, the normally open spring having a second contact rivet, permanently attached to the normally open spring, with a third contact surface, and a third planar shaped end, the normally open terminal having a fourth planar shaped end, the third planar shaped end of the normally open spring and the fourth planar shaped end of the normally open terminal being ultrasonically metal-to-metal welded to each other forming a planar shaped weld spanning the area between the third planar shaped end of the normally open spring and the fourth planar shaped end of the normally open terminal allowing for greater current flow between the normally open spring and the normally open terminal, the normally open spring positioned relatively parallel to the center contact spring, the normally open spring vertically positioned with respect to the center contact spring assembly so that the center contact spring contacts the normally open spring when the center contact spring is acted upon by the actuator.

17. The electromagnetic relay device in claim 16 wherein the normally open spring is made from a copper alloy having a chemical composition of 0.3% Cr, 0.1%Ti, 0.02%Si, and the balance.

18. The electromagnetic relay device defined in claim 11 further comprising a normally closed contact spring assembly, the normally closed contact spring assembly being curl shaped, the normally closed contact spring assembly having a normally closed spring made of a copper alloy having a chemical composition of 0.3% Cr, 0.1%Ti, 0.02%Si, and the balance Cu and a normally closed terminal made of pure copper, the normally closed spring having a third contact rivet, permanently attached to the normally closed spring with a fourth contact surface, and a fifth planar shaped end, the normally closed terminal having a sixth planar shaped end, the fifth planar shaped end of the normally closed spring and the sixth planar shaped end of the normally closed terminal being ultrasonically metal-to-metal welded to each other forming a planar shaped weld spanning the area between the fifth planar shaped end of the normally closed spring and the sixth planar shaped end of the normally closed terminal allowing for greater current flow between the normally closed spring and the normally closed terminal, the normally closed contact spring assembly is vertically positioned with respect to the center contact spring so that the third contact rivet is in contact with the second contact surface of the first contact rivet when the center contact spring is not being acted upon by the actuator and the pressure spring.

19. The electromagnetic relay device defined in claim 11 wherein the center contact spring of the center contact spring assembly has a first slot therethrough, and the normally open spring of the normally open contact spring assembly has a second slot therethrough, the first slot and the second slot reducing the cross section of the center contact spring and the normally open spring, reducing the bending force of both the center contact spring and the normally open spring, and reducing the electrical power consumption of the relay coil.

20. An electromagnetic relay device comprising:

a relay motor, the relay motor having a relay coil;

an armature, the armature coupled to the relay motor;

an actuator, the actuator operatively coupled to the armature;

a center contact spring assembly, the center contact spring assembly having a center contact spring having a first planar shaped end, the center contact terminal having a second planar shaped end, the first planar shaped end of the center contact spring and the second planar shaped end of the center contact terminal being ultrasonically metal-to-metal welded to each other forming a planar shaped weld spanning the area between the first planar shaped end of the center contact spring and the second planar shaped end of the center contact terminal, the center contact spring operatively coupled to the actuator; and a pressure spring, the pressure spring being made of steel, the pressure spring having a retaining end, the retaining end positioned opposite of the normally open contact spring assembly for positioning the pressure spring, the pressure spring further having a pressure end, the pressure end contacting the center contact spring perpendicularly above the actuator, the pressure end applying pressure to the center contact spring for pressuring the second contact surface of the first contact rivet into contact with the fourth contact surface of the third contact rivet without pre bending the center contact spring when the center contact spring is not being acted upon by the actuator.

21. The electromagnetic relay in claim 20 wherein the center contact spring having a first planar shaped end, the center contact terminal having a second planar shaped end, the first planar shaped end of the center contact spring and the second planar shaped end of the center contact terminal being ultrasonically metal-to-metal welded to each other forming a planar shaped weld spanning the area between the first planar shaped end of the center contact spring and the second planar shaped end of the center contact terminal allowing for greater current flow between the center contact spring and the center contact terminal.

22. An electromagnetic relay device comprising:

a relay motor, the relay motor having a relay coil;

an armature, the armature coupled to the relay motor;

an actuator, the actuator operatively coupled to the armature;

a center contact spring assembly, the center contact spring assembly having a center contact spring the center contact spring having a first planar shaped end, the center contact terminal having a second planar shaped end, the first planar shaped end of the center contact spring and the second planar shaped end of the center contact terminal being ultrasonically metal-to-metal welded to each other forming a planar shaped weld spanning the area between the first planar shaped end of the center contact spring and the second planar shaped end of the center contact terminal allowing for greater current flow between the center contact spring and the center contact terminal; and a pressure spring, the pressure spring being made of steel, the pressure spring having a retaining end positioning the pressure spring, the pressure spring further having a pressure end, the pressure end contacting the center contact spring perpendicularly above the actuator, the pressure end applying pressure to the center contact spring without pre bending the center contact spring when the center contact spring is not being acted upon by the actuator.

23. An electromagnetic relay device comprising:

a relay motor assembly, the relay motor assembly comprising an elongated coil bobbin having an axially extending cavity therein and an excitation coil wound therearound, a generally U shaped ferromagnetic frame, the ferromagnetic frame having a plurality of core sections being disposed in and extending through the axially extending cavity in the elongated coil bobbin and a first and second contact sections extending generally perpendicularly to the core section and rising above the relay motor assembly;

an actuator, the actuator comprising an actuator frame operatively coupled to a first and a second generally U shaped ferromagnetic pole pieces, and a permanent magnet, the first pole piece mounted in overlapping relation over the second pole piece, the permanent magnet lying sandwiched therebetween, the actuator positioned so the second pole piece is located in between the first and second contact sections of the ferromagnetic frame and the first pole piece is located in overlapping relation across from the two contact sections of the relay motor, the first and second pole pieces magnetically coupled to opposite contact sections;

a center contact spring assembly, the center contact spring assembly comprising a center contact spring, the center contact spring being formed straight without pre bending, the center contact spring made of a copper alloy comprising a chemical composition of 0.3% Cr, 0.1%Ti, 0.02%Si, and the balance Cu, and a center contact terminal made of pure copper, the center contact spring having a first contact rivet, permanently attached to the center contact spring with a first contact surface and a second contact surface, and a first planar shaped end, the center contact terminal having a second planar shaped end, the first planar shaped end of the center contact spring and the second planar shaped end of the center contact terminal being ultrasonically metal-to-metal welded to each other forming a planar shaped weld spanning the area between the first planar shaped end of the center contact spring and the second planar shaped end of the center contact terminal allowing for greater current flow between the center contact spring and the center contact terminal, the center contact spring assembly operatively coupled to the actuator;

a normally open contact spring assembly, the normally open contact spring assembly being curl shaped, the normally open contact spring assembly having a normally open spring made of a copper alloy comprising a chemical composition of 0.3% Cr, 0.1%Ti, 0.02%Si, and the balance Cu and a normally open terminal made of pure copper, the normally open spring having a second contact rivet, permanently attached to the normally open spring, with a third contact surface, and a third planar shaped end, the normally open terminal having a fourth planar shaped end, the third planar shaped end of the normally open spring and the fourth planar shaped end of the normally open terminal being ultrasonically metal-to-metal welded to each other forming a planar shaped weld spanning the area between the third planar shaped end of the normally open spring and the fourth planar shaped end of the normally open terminal allowing for greater current flow between the normally open spring and the normally open terminal, the normally open spring positioned relatively parallel to the center contact spring with the second contact rivet positioned opposite the first contact surface of the first contact rivet, the normally open spring vertically positioned with respect to the center contact spring assembly so that the first contact surface of the first contact rivet touches the second contact rivet when the center contact spring is acted upon by the actuator;

a normally closed contact spring assembly, the normally closed contact spring assembly being curl shaped, the normally closed contact spring assembly having a normally closed spring made of a copper alloy comprising a chemical composition of 0.3% Cr, 0.1%Ti, 0.02%Si, and the balance Cu and a normally closed terminal made of pure copper, the normally closed spring having a third contact rivet, permanently attached to the normally closed spring with a fourth contact surface, and a fifth planar shaped end, the normally closed terminal having a sixth planar shaped end, the fifth planar shaped end of the normally closed spring and the sixth planar shaped end of the normally closed terminal being ultrasonically metal-to-metal welded to each other forming a planar shaped weld spanning the area between the fifth planar shaped end of the normally closed spring and the sixth planar shaped end of the normally closed terminal allowing for greater current flow between the normally closed spring and the normally closed terminal, the normally closed contact spring assembly is vertically positioned with respect to the center contact spring so that the third contact rivet is in contact with the second contact surface of the first contact rivet when the center contact spring is not being acted upon by the actuator;

a pressure spring, the pressure spring being made of steel, the pressure spring having a retaining end, the retaining end positioned opposite of the normally open contact spring assembly for positioning the pressure spring, the pressure spring further having a pressure end, the pressure end contacting the center contact spring perpendicularly above the actuator, the pressure end applying pressure to the center contact spring for pressuring the second contact surface of the first contact rivet into contact with the fourth contact surface of the third contact rivet without pre bending the center contact spring when the center contact spring is not being acted upon by the actuator; and a housing, the housing having the relay motor, the actuator, the center contact spring assembly, the normally open contact spring assembly, the normally closed contact spring assembly, and the pressure spring disposed therein.

24. The electromagnetic relay device defined in claim 23 wherein the center contact spring of the center contact spring assembly has a first slot therethrough, and the normally open spring of the normally open contact spring assembly has a second slot therethrough, the first slot and the second slot reducing the cross section of the center contact spring and the normally open spring, reducing the bending force of both the center contact spring and the normally open spring, and reducing the electrical power consumption of the excitation coil.

25. The electromagnetic relay device defined in claim 23 wherein the electromagnetic relay device has a plurality of center contact spring assemblies, normally open contact spring assemblies, normally closed contact spring assemblies and pressure springs.

26. An electromagnetic relay device comprising:

a relay motor assembly, the relay motor assembly comprising an elongated coil bobbin having an axially extending cavity therein and an excitation coil wound therearound, a generally U shaped ferromagnetic frame, the ferromagnetic frame having a plurality of core sections being disposed in and extending through the axially extending cavity in the elongated coil bobbin and a first and second contact sections extending generally perpendicularly to the core section and rising above the relay motor assembly;

an actuator, the actuator comprising an actuator frame operatively coupled to a first and a second generally U shaped ferromagnetic pole pieces, and a permanent magnet, the first pole piece mounted in overlapping relation over the second pole piece, the permanent magnet lying sandwiched therebetween, the actuator positioned so the second pole piece is located in between the first and second contact sections of the ferromagnetic frame and the first pole piece is located in overlapping relation across from the two contact sections of the relay motor, the first and second pole pieces magnetically coupled to opposite contact sections;

a center contact spring assembly, the center contact spring assembly having a center contact spring, the center contact spring being formed straight without pre bending, the center contact spring made of a copper alloy with a conductivity which is 50% of the conductivity of pure copper or greater and a center contact terminal made of pure copper, the center contact spring having a first contact rivet, permanently attached to the center contact spring with a first contact surface and a second contact surface, and a first planar shaped end, the center contact terminal having a second planar shaped end, the first planar shaped end of the center contact spring and the second planar shaped end of the center contact terminal being ultrasonically metal-to-metal welded to each other forming a planar shaped weld spanning the area between the first planar shaped end of the center contact spring and the second planar shaped end of the center contact terminal allowing for greater current flow between the center contact spring and the center contact terminal, the center contact spring assembly operatively coupled to the second actuator end;

a pressure spring, the pressure spring being made of steel, the pressure spring having a retaining end, the retaining end positioned opposite of the normally open contact spring assembly for positioning the pressure spring, the pressure spring further having a pressure end, the pressure end contacting the center contact spring perpendicularly above the actuator, pressing the center contact spring in contact with the second actuator end; and a housing, the housing having the relay motor, the armature, the actuator, the center contact spring assembly, and the pressure spring disposed therein.

27. The electromagnetic relay device defined in claim 26 wherein the center contact spring has a first contact rivet permanently attached to the center contact spring with a first contact surface and a second contact surface.

28. The electromagnetic relay device defined in claim 26 wherein the center contact spring having a first contact rivet, permanently attached to the center contact spring with a first contact surface and a second contact surface, and a first planar shaped end, the center contact terminal having a second planar shaped end, the first planar shaped end of the center contact spring and the second planar shaped end of the center contact terminal being ultrasonically metal-to-metal welded to each other forming a planar shaped weld spanning the area between the first planar shaped end of the center contact spring and the second planar shaped end of the center contact terminal allowing for greater current flow between the center contact spring and the center contact terminal.

29. The electromagnetic relay device in claim 26 further comprising a normally open contact spring assembly, the normally open contact spring assembly being curl shaped, the normally open contact spring assembly having a normally open spring made of a copper alloy with a conductivity which is 50% of the conductivity of pure copper or greater and a normally open terminal made of pure copper, the normally open spring having a second contact rivet, permanently attached to the normally open spring, with a third contact surface, and a third planar shaped end, the normally open terminal having a fourth planar shaped end, the third planar shaped end of the normally open spring and the fourth planar shaped end of the normally open terminal being ultrasonically metal-to-metal welded to each other forming a planar shaped weld spanning the area between the third planar shaped end of the normally open spring and the fourth planar shaped end of the normally open terminal allowing for greater current flow between the normally open spring and the normally open terminal, the normally open spring positioned relatively parallel to the center contact spring, the normally open spring vertically positioned with respect to the center contact spring assembly so that the center contact spring contacts the normally open spring when the center contact spring is acted upon by the actuator.

30. The electromagnetic relay device in claim 26 wherein the center contact spring and the normally open spring are made from a copper alloy having a chemical composition of 0.3% Cr, 0.1%Ti, 0.02%Si, and the balance of Cu.

31. The electromagnetic relay device defined in claim 26 further comprising a normally closed contact spring assembly, the normally closed contact spring assembly being curl shaped, the normally closed contact spring assembly having a normally closed spring made of a copper alloy having a chemical composition of 0.3% Cr, 0.1%Ti, 0.02%Si, and the balance Cu and a normally closed terminal made of pure copper, the normally closed spring having a third contact rivet, permanently attached to the normally closed spring with a fourth contact surface, and a fifth planar shaped end, the normally closed terminal having a sixth planar shaped end, the fifth planar shaped end of the normally closed spring and the sixth planar shaped end of the normally closed terminal being ultrasonically metal-to-metal welded to each other forming a planar shaped weld spanning the area between the fifth planar shaped end of the normally closed spring and the sixth planar shaped end of the normally closed terminal allowing for greater current flow between the normally closed spring and the normally closed terminal, the normally closed contact spring assembly is vertically positioned with respect to the center contact spring so that the third contact rivet is in contact with the second contact surface of the first contact rivet when the center contact spring is not being acted upon by the actuator and the pressure spring.

32. An electromagnetic relay device comprising:

a relay motor assembly, the relay motor assembly comprising an elongated coil bobbin having an axially extending cavity therein and an excitation coil wound therearound, a generally U shaped ferromagnetic frame, the ferromagnetic frame having a plurality of core sections being disposed in and extending through the axially extending cavity in the elongated coil bobbin and a first and second contact sections extending generally perpendicularly to the core section and rising above the relay motor assembly;

an actuator, the actuator comprising an actuator frame operatively coupled to a first and a second generally U shaped ferromagnetic pole pieces, and a permanent magnet, the first pole piece mounted in overlapping relation over the second pole piece, the permanent magnet lying sandwiched therebetween, the actuator positioned so the second pole piece is located in between the first and second contact sections of the ferromagnetic frame and the first pole piece is located in overlapping relation across from the two contact sections of the relay motor, the first and second pole pieces magnetically coupled to opposite contact sections;

a center contact spring assembly, the center contact spring assembly having the center contact spring having a first contact rivet, permanently attached to the center contact spring with a first contact surface and a second contact surface, and a first planar shaped end, the center contact terminal having a second planar shaped end, the first planar shaped end of the center contact spring and the second planar shaped end of the center contact terminal being ultrasonically metal-to-metal welded to each other forming a planar shaped weld spanning the area between the first planar shaped end of the center contact spring and the second planar shaped end of the center contact terminal allowing for greater current flow between the center contact spring and the center contact terminal; and a pressure spring, the pressure spring being made of steel, the pressure spring having a retaining end for positioning the pressure spring, the pressure spring further having a pressure end, the pressure end contacting the center contact spring perpendicularly above the actuator, the pressure end applying pressure force to the center contact spring for pressuring contact on the center contact spring at an angle without pre bending the center contact spring when the center contact spring is not being acted upon by the actuator and the pressure spring.

* * * * *